US010194707B2

(12) United States Patent
Turner

(10) Patent No.: US 10,194,707 B2
(45) **Date of Patent: *Feb. 5, 2019**

(54) APPAREL INCORPORATING A PROTECTIVE ELEMENT

(71) Applicant: NIKE, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/600,370

(22) Filed: May 19, 2017

(65) Prior Publication Data

US 2017/0295864 A1 Oct. 19, 2017

Related U.S. Application Data

(63) Continuation of application No. 14/874,161, filed on Oct. 2, 2015, now Pat. No. 9,675,122, which is a (Continued)

(51) Int. Cl.
*A41D 31/00* (2006.01)
*A41D 13/015* (2006.01)

(Continued)

(52) U.S. Cl.
CPC ..... *A41D 13/0543* (2013.01); *A41D 13/015* (2013.01); *A41D 13/0512* (2013.01); *A41D 13/0562* (2013.01)

(58) Field of Classification Search
CPC .. A41D 13/0153; A41D 13/05; A41D 13/015; A41D 13/0562; A41D 13/0568; A41D 13/0593; A41D 13/0015; A41D 13/0543; A41D 13/0587; A41D 13/0506; A41D 13/0581; A41D 13/065; A41D 13/0156; A41D 13/01; A41D 13/0556;

(Continued)

(56) References Cited

U.S. PATENT DOCUMENTS 921,352 A 5/1909 Blaker et al.
1,282,411 A 10/1918 Golembiowski et al.

(Continued)

FOREIGN PATENT DOCUMENTS

CA 892301 A 2/1972
CA 2063814 A1 1/1991

(Continued)

OTHER PUBLICATIONS

Joseph F. Annis & Paul Webb, "Development of a Space Activity Suit", in NASA Contractor Report NASA CR-1892; dated Nov. 1971; 139 pages.

(Continued)

*Primary Examiner* — Bobby Muromoto, Jr.
(74) *Attorney, Agent, or Firm* — Shook Hardy & Bacon, LLP

(57) ABSTRACT

Protective components may include a plate element and a cushioning element that are secured together with a hook-and-loop fastening system. The cushioning element may include a pair of material layers and a pad or a plurality of pad components located between the material layers. The plate element may include a polymer material and the pad may include a polymer foam material.

20 Claims, 41 Drawing Sheets

Related U.S. Application Data continuation-in-part of application No. 13/927,436, filed on Jun. 26, 2013, now Pat. No. 9,149,084, which is a continuation-in-part of application No. 13/889,018, filed on May 7, 2013, now Pat. No. 8,713,719, which is a continuation of application No. 13/111,461, filed on May 19, 2011, now Pat. No. 8,438,669, which is a continuation-in-part of application No. 12/490,001, filed on Jun. 23, 2009, now Pat. No. 8,095,996.

(51) Int. Cl.
*A41D 13/05* (2006.01)
*A41D 13/00* (2006.01)

(58) Field of Classification Search
CPC .... A41D 13/0575; A41D 13/08; A41D 13/02; A41D 1/06; A41D 1/082; A41D 2300/20; A41D 31/005; A41D 13/00; A41D 13/0002; A41D 19/01523; A41D 1/08; A41D 27/00; A63B 2071/1208; A63B 71/1225; A63B 71/08; A63B 2017/1233; A63B 2209/10; A63B 2243/0041; A63B 71/143
USPC ..... 2/2, 16, 22, 24, 267, 268, 243 R, 243 A, 2/DIG. 1, 44, 45; 128/89 R, 156, 157
See application file for complete search history.

(56) References Cited

U.S. PATENT DOCUMENTS 1,910,810 A 5/1933 Nash et al.
1,924,677 A 8/1933 Cadgene et al.
2,266,886 A 12/1941 McCoy et al.
2,569,398 A 9/1951 Burd et al.
2,723,214 A 11/1955 Meyer et al.
2,738,834 A 3/1956 Jaffe et al.
2,751,609 A 6/1956 Oesterling et al.
2,785,739 A 3/1957 McGregor, Jr. et al.
3,012,926 A 12/1961 Wintermute et al.
3,020,186 A 2/1962 Lawrence et al.
3,119,904 A 1/1964 Anson et al.
3,137,746 A 6/1964 Seymour et al.
3,233,885 A 2/1966 Propst et al.
3,258,800 A 7/1966 Robinsky et al.
3,285,768 A 11/1966 Habib et al.
3,293,671 A 12/1966 Griffin et al.
3,305,423 A 2/1967 Le Masson et al.
3,404,406 A 10/1968 Balliet et al.
3,441,638 A 4/1969 Stephenson et al.
3,465,364 A 9/1969 Edelson et al.
3,471,865 A 10/1969 Molitoris et al.
3,500,472 A 3/1970 Castellani et al.
3,510,560 A 5/1970 Saunders et al.
3,512,190 A 5/1970 Buff
3,515,625 A 6/1970 Sedlak et al.
3,679,263 A 7/1972 Cadiou et al.
3,722,355 A 3/1973 King
3,746,602 A 7/1973 Giuffrida et al.
3,746,605 A 7/1973 Dillon et al.
3,772,704 A 11/1973 Carbonneau et al.
3,775,526 A 11/1973 Gilmore et al.
3,832,265 A 8/1974 Denommee
3,867,238 A 2/1975 Johannsen et al.
3,867,239 A 2/1975 Alesi et al.
3,882,547 A 5/1975 Morgan
3,911,185 A 10/1975 Wright, Jr. et al.
3,914,487 A 10/1975 Azoulay et al.
3,922,329 A 11/1975 Kim et al.
3,977,406 A 8/1976 Roth et al.
3,991,420 A 11/1976 Savarino et al.
4,023,213 A 5/1977 Rovani et al.
4,126,177 A 11/1978 Smith et al.
4,136,222 A 1/1979 Jonnes et al.
4,138,283 A 2/1979 Hanusa
4,190,696 A 2/1980 Fuoco et al.
4,197,342 A 4/1980 Bethe
4,249,302 A 2/1981 Crepeau et al.
4,255,552 A 3/1981 Schollenberger et al.
4,272,850 A 6/1981 Rule et al.
4,276,341 A 6/1981 Tanaka et al.
4,322,858 A 4/1982 Douglas
4,415,622 A 11/1983 Kamat et al.
4,422,183 A 12/1983 Landi et al.
4,440,525 A 4/1984 Perla et al.
4,441,211 A 4/1984 Donzis et al.
4,482,592 A 11/1984 Kramer et al.
4,485,919 A 12/1984 Sandel et al.
4,493,865 A 1/1985 Kuhlmann et al.
4,507,801 A 4/1985 Kavanagh et al.
4,512,037 A 4/1985 Vacanti et al.
4,516,273 A 5/1985 Gregory et al.
4,525,875 A 7/1985 Tomczak et al.
4,534,354 A 8/1985 Bonner, Jr. et al.
4,538,301 A 9/1985 Sawatzki et al.
4,559,251 A 12/1985 Wachi et al.
4,580,297 A 4/1986 Maejima et al.
4,581,186 A 4/1986 Larson et al.
4,599,747 A 7/1986 Robinson et al.
4,631,221 A 12/1986 Disselbeck et al.
4,642,814 A 2/1987 Godfrey
4,646,367 A 3/1987 El Hassen et al.
4,688,269 A 8/1987 Maeshima et al.
4,692,199 A 9/1987 Kozlowski et al.
4,713,854 A 12/1987 Graebe et al.
4,718,214 A 1/1988 Waggoner
4,730,761 A 3/1988 Spano et al.
4,734,306 A 3/1988 Lassiter et al.
4,756,026 A 7/1988 Pierce, Jr. et al.
4,774,724 A 10/1988 Sacks
4,780,167 A 10/1988 Hill et al.
4,809,374 A 3/1989 Saviez et al.
4,852,274 A 8/1989 Wilson et al.
4,856,393 A 8/1989 Braddon et al.
4,867,826 A 9/1989 Wayte et al.
4,884,295 A 12/1989 Cox et al.
4,964,936 A 10/1990 Ferro et al.
4,982,447 A 1/1991 Henson et al.
4,985,931 A 1/1991 Wingo, Jr. et al.
4,985,933 A 1/1991 Lemoine et al.
4,989,265 A 2/1991 Nipper et al.
4,991,230 A 2/1991 Vacanti et al.
5,007,111 A 4/1991 Adams et al.
5,014,354 A 5/1991 Dumont et al.
5,020,156 A 6/1991 Neuhalfen
5,020,157 A 6/1991 Dyer et al.
5,029,341 A 7/1991 Wingo, Jr. et al.
5,030,501 A 7/1991 Colvin et al.
5,042,318 A 8/1991 Franz
5,052,052 A 10/1991 Gilford et al.
5,052,053 A 10/1991 Peart et al.
5,060,313 A 10/1991 Neuhalfen et al.
5,067,175 A 11/1991 Gold
5,071,698 A 12/1991 Scheerder et al.
5,129,295 A 7/1992 Geffros et al.
5,160,785 A 11/1992 Davidson, Jr. et al.
5,168,576 A 12/1992 Krent et al.
5,188,879 A 2/1993 Hill et al.
5,214,797 A 6/1993 Tisdale et al.
5,220,691 A 6/1993 Wiegers et al.
5,232,762 A 8/1993 Ruby
5,233,767 A 8/1993 Kramer
5,274,846 A 1/1994 Kolsky et al.
5,289,830 A 3/1994 Levine et al.
5,322,730 A 6/1994 Ou et al.
5,325,537 A 7/1994 Marion et al.
5,337,418 A 8/1994 Kato et al.
5,349,893 A 9/1994 Dunn et al.
5,353,455 A 10/1994 Loving et al.
5,360,653 A 11/1994 Ackley et al.
5,373,584 A 12/1994 Parcells, III et al.
5,380,392 A 1/1995 Imamura et al.

(56) References Cited

U.S. PATENT DOCUMENTS

| | | | |
|---|---|---|---|
| 5,399,418 | A | 3/1995 | Hartmanns et al. |
| 5,405,665 | A | 4/1995 | Shukushima et al. |
| 5,407,421 | A | 4/1995 | Goldsmith et al. |
| 5,423,087 | A | 6/1995 | Krent et al. |
| 5,452,477 | A | 9/1995 | Mann |
| 5,459,896 | A | 10/1995 | Raburn et al. |
| 5,477,558 | A | 12/1995 | Voelker et al. |
| 5,530,966 | A | 7/1996 | West et al. |
| 5,534,208 | A | 7/1996 | Barr et al. |
| 5,534,343 | A | 7/1996 | Landi et al. |
| 5,551,082 | A | 9/1996 | Stewart et al. |
| 5,594,954 | A | 1/1997 | Huang |
| 5,601,895 | A | 2/1997 | Cunningham et al. |
| 5,614,301 | A | 3/1997 | Katz et al. |
| 5,621,914 | A | 4/1997 | Ramone et al. |
| 5,628,063 | A | 5/1997 | Reed et al. |
| 5,660,572 | A | 8/1997 | Buck et al. |
| 5,675,844 | A | 10/1997 | Guyton et al. |
| 5,689,836 | A | 11/1997 | Fee et al. |
| 5,692,935 | A | 12/1997 | Smith et al. |
| 5,697,101 | A | 12/1997 | Aldridge |
| 5,720,714 | A | 2/1998 | Penrose et al. |
| 5,727,252 | A | 3/1998 | Oetting et al. |
| 5,729,832 | A | 3/1998 | Grilliot et al. |
| 5,738,925 | A | 4/1998 | Chaput et al. |
| 5,780,147 | A | 7/1998 | Sugahara et al. |
| 5,823,981 | A | 10/1998 | Grim et al. |
| 5,915,819 | A | 6/1999 | Gooding |
| 5,920,915 | A | 7/1999 | Bainbridge et al. |
| 5,938,878 | A | 8/1999 | Hurley et al. |
| 5,940,888 | A | 8/1999 | Sher et al. |
| 5,948,621 | A | 9/1999 | Turner et al. |
| 5,987,643 | A | 11/1999 | Beutler et al. |
| 6,041,447 | A | 3/2000 | Endler et al. |
| 6,053,005 | A | 4/2000 | Boitnott et al. |
| 6,070,267 | A | 6/2000 | McKewin et al. |
| 6,070,273 | A | 6/2000 | Sgro et al. |
| 6,085,353 | A | 7/2000 | Van Der Sleesen et al. |
| 6,093,468 | A | 7/2000 | Toms et al. |
| 6,105,162 | A | 8/2000 | Douglas et al. |
| 6,167,790 | B1 | 1/2001 | Bambara et al. |
| 6,205,583 | B1 | 3/2001 | Beland |
| 6,219,852 | B1 | 4/2001 | Bain et al. |
| 6,235,661 | B1 | 5/2001 | Khanamirian |
| 6,253,376 | B1 | 7/2001 | Ritter |
| 6,295,654 | B1 | 10/2001 | Farrell |
| 6,301,722 | B1 | 10/2001 | Nickerson et al. |
| 6,317,888 | B1 | 11/2001 | McFarlane |
| 6,374,409 | B1 | 4/2002 | Galy |
| 6,401,366 | B2 | 6/2002 | Foxen et al. |
| 6,485,448 | B2 | 11/2002 | Lamping et al. |
| 6,510,560 | B1 | 1/2003 | Ugolnik |
| 6,519,782 | B2 | 2/2003 | Collins et al. |
| 6,584,616 | B2 | 7/2003 | Godshaw et al. |
| 6,654,960 | B2 | 12/2003 | Cho |
| 6,654,962 | B2 | 12/2003 | DeMott |
| 6,743,325 | B1 | 6/2004 | Taylor |
| 6,817,039 | B1 | 11/2004 | Grilliot et al. |
| 6,820,279 | B2 | 11/2004 | Lesosky |
| 6,841,022 | B2 | 1/2005 | Tsukagoshi et al. |
| 6,851,124 | B2 | 2/2005 | Munoz et al. |
| 6,968,573 | B2 | 11/2005 | Silver |
| 6,969,548 | B1 | 11/2005 | Goldfine |
| 7,007,356 | B2 | 3/2006 | Cudney et al. |
| 7,018,351 | B1 | 3/2006 | Iglesias et al. |
| 7,114,189 | B1 | 10/2006 | Kleinert |
| 7,188,370 | B2 | 3/2007 | Bevier |
| 7,316,083 | B2 | 1/2008 | Labont |
| 7,350,240 | B2 | 4/2008 | LaGrone |
| 7,506,384 | B2 | 3/2009 | Ide et al. |
| 7,512,996 | B2 | 4/2009 | Yoo et al. |
| RE41,346 | E | 5/2010 | Taylor |
| 7,707,658 | B2 | 5/2010 | Culhane |
| 7,743,429 | B2 | 6/2010 | Bevier |
| 7,761,929 | B1 | 7/2010 | Mascia |
| 7,832,017 | B2 | 11/2010 | Nascimento et al. |
| RE42,689 | E | 9/2011 | Taylor |
| 8,095,996 | B2 * | 1/2012 | Turner ..... A41D 13/0587 2/22 |
| RE43,441 | E | 6/2012 | Taylor |
| 8,231,756 | B2 | 7/2012 | Kim |
| RE43,994 | E | 2/2013 | Taylor |
| 8,438,669 | B2 * | 5/2013 | Turner ..... A41D 13/05 2/22 |
| 8,713,719 | B2 * | 5/2014 | Turner ..... A41D 13/05 2/22 |
| 9,149,084 | B2 * | 10/2015 | Turner ..... A41H 43/00 |
| 9,675,122 | B2 * | 6/2017 | Turner ..... A41D 13/015 |
| 2004/0229763 | A1 | 11/2004 | Hutton, III et al. |
| 2005/0081277 | A1 | 4/2005 | Matechen et al. |
| 2005/0167029 | A1 | 8/2005 | Rapaport et al. |
| 2005/0246812 | A1 | 11/2005 | Bevier |
| 2005/0268370 | A1 | 12/2005 | Frieler et al. |
| 2006/0199456 | A1 | 9/2006 | Taylor |
| 2006/0260026 | A1 | 11/2006 | Doria et al. |
| 2007/0000005 | A1 | 1/2007 | Wang |
| 2007/0124843 | A1 | 6/2007 | Bevier |
| 2008/0178360 | A1 | 7/2008 | Nascimento et al. |
| 2008/0178361 | A1 | 7/2008 | Yoo et al. |
| 2008/0264557 | A1 | 10/2008 | Kim |
| 2008/0290556 | A1 | 11/2008 | Kim |
| 2009/0070911 | A1 | 3/2009 | Chang |
| 2009/0152774 | A1 | 6/2009 | Hensley et al. |
| 2009/0288312 | A1 | 11/2009 | Dua |
| 2009/0288313 | A1 | 11/2009 | Rapaport et al. |
| 2010/0024089 | A1 | 2/2010 | Turner |
| 2010/0024100 | A1 | 2/2010 | Sokolowski et al. |
| 2010/0024101 | A1 | 2/2010 | Berner, Jr. et al. |
| 2010/0129573 | A1 | 5/2010 | Kim |
| 2010/0193117 | A1 | 8/2010 | Kim |
| 2010/0199406 | A1 | 8/2010 | Dua et al. |
| 2010/0205716 | A1 | 8/2010 | Kim |
| 2010/0205722 | A1 | 8/2010 | Kim |
| 2010/0206472 | A1 | 8/2010 | Kim |
| 2010/0319097 | A1 | 12/2010 | Turner |
| 2011/0277226 | A1 | 11/2011 | Turner |

FOREIGN PATENT DOCUMENTS

| | | | |
|---|---|---|---|
| CA | 2162723 | A1 | 11/1994 |
| CA | 2289622 | A1 | 11/1998 |
| CH | 638665 | A5 | 10/1983 |
| CN | 2225163 | Y | 4/1996 |
| CN | 2305870 | Y | 2/1999 |
| CN | 1230611 | A | 10/1999 |
| CN | 102458167 | A | 5/2012 |
| DE | 3119489 | A1 | 12/1982 |
| DE | 3530397 | A1 | 3/1987 |
| DE | 9102039 | U1 | 2/1991 |
| DE | 4336468 | A1 | 4/1995 |
| DE | 29619260 | U1 | 2/1997 |
| EP | 254751 | A1 | 2/1988 |
| EP | 0083454 | | 10/1988 |
| EP | 552304 | A1 | 7/1993 |
| EP | 595887 | A1 | 12/1998 |
| EP | 2445364 | A1 | 5/2012 |
| FR | 2740303 | A1 | 4/1997 |
| GB | 832101 | A | 4/1960 |
| GB | 1274569 | A | 5/1972 |
| GB | 2120167 | A | 11/1983 |
| GB | 2177892 | A | 2/1987 |
| GB | 2233877 | A | 1/1991 |
| JP | 1316235 | | 12/1989 |
| JP | 2508289 | B2 | 6/1994 |
| JP | 10053905 | A | 2/1998 |
| JP | 10337797 | A | 12/1998 |
| WO | 9723142 | | 7/1997 |
| WO | 9733403 | | 9/1997 |
| WO | 9733493 | A1 | 9/1997 |
| WO | 9736740 | | 10/1997 |
| WO | 9934972 | | 7/1999 |
| WO | 9935926 | | 7/1999 |
| WO | 200050336 | | 8/2000 |
| WO | 200103530 | A1 | 1/2001 |

(56) References Cited

FOREIGN PATENT DOCUMENTS

| | | | |
|---|---|---|---|
| WO | 0115892 | | 3/2001 |
| WO | 0216124 | A1 | 2/2002 |
| WO | 02081202 | A1 | 10/2002 |
| WO | 2006036072 | A1 | 4/2006 |
| WO | 2006088734 | A2 | 8/2006 |
| WO | 2010151520 | A1 | 12/2010 |

OTHER PUBLICATIONS

Andrew Alderson, "A Triumph of Lateral Thought", in Chemistry & Industry, May 17, 1999; pp. 384-391.

Maria Burke, "A Stretch of the Imagination", New Scientist Magazine, vol. 154 issue 2085, Jul. 6, 1997 at p. 36 (available from research.dh.umu.se/dynamic/artiklar/shape/stretch.html, last accessed Nov. 11, 2013).

Joseph Hamill & Carolyn K. Bensel, "Biomechanical Analysis of Military Boots: Phase III", in United States Army Technical Report NATICK/TR-96.013; dated Mar. 11, 1996; 42 pages.

* cited by examiner

APPAREL INCORPORATING A PROTECTIVE ELEMENT

CROSS-REFERENCE TO RELATED APPLICATION

This application is a continuation of U.S. patent application Ser. No. 14/874,161 (filed Oct. 2, 2015), which is a continuation-in-part of U.S. patent application Ser. No. 13/927,436 (filed on Jun. 26, 2013, and issued as U.S. Pat. No. 9,149,084 on Oct. 6, 2015), which is a continuation-in-part of U.S. patent application Ser. No. 13/889,018 (filed on May 7, 2013, and issued as U.S. Pat. No. 8,713,719 on May 6, 2014), which is a continuation of U.S. patent application Ser. No. 13/111,461 (filed on May 19, 2011, and issued as U.S. Pat. No. 8,438,669 on May 14, 2013), which is a continuation-in-part of U.S. patent application Ser. No. 12/490,001 (filed Jun. 23, 2009, and issued as U.S. Pat. No. 8,095,996 on Jan. 17, 2012). The disclosures of all of the aforementioned patent documents are hereby incorporated by reference in their respective entirety.

BACKGROUND

Articles of athletic apparel commonly incorporate elements that cushion or protect an athlete from contact with other athletes, equipment, or the ground. Examples of these elements include (a) foam components that impart cushioning or otherwise attenuate impact forces and (b) rigid or semi-rigid plates that distribute impact forces. Many articles of athletic apparel combine foam components and plates to protect to the athlete by both attenuating and distributing impact forces. That is, the combination of a foam component and a plate may impart enhanced protection by both attenuating and distributing impact forces. As an example, shoulder pads and thigh pads worn under uniforms in American football include (a) foam components located adjacent to the athlete (i.e., in contact with the athlete or apparel worn adjacent to the skin of the athlete) and (b) plates secured to the foam components and located opposite the athlete. As another example, helmets utilized during American football, bicycling, hockey, skiing, snowboarding, and skateboarding also effectively combine polymer foam components with an external plate (i.e., the exterior of the helmet). Additionally, shin guards worn for soccer and leg guards worn for baseball include polymer foam components and an external plate.

SUMMARY

Various protective elements that may be utilized in articles of protective apparel are disclosed below. The apparel may include a plate element and a cushioning element. The plate element has a first part of a hook-and-loop fastening system, and the cushioning element incorporates a second part of the hook-and-loop fastening system. The first part of the hook-and-loop fastening system is joinable to the second part of the hook-and-loop fastening system to secure the plate element to the cushioning element.

Aspects of the technology are defined by the claims below, not this Summary. A high-level overview of various aspects of the invention is provided here to introduce a selection of concepts that are further described below in the detailed-description section. This Summary is not intended to identify key features or essential features of the claimed subject matter, nor is it intended to be used as an aid in isolation to determine the scope of the claimed subject matter.

FIGURE DESCRIPTIONS

The foregoing Summary and the following Detailed Description will be better understood when read in conjunction with the accompanying figures, which are incorporated herein by reference and include the below listed figures.

DETAILED DESCRIPTION

The subject matter of aspects of the technology is described with specificity herein to meet statutory requirements. But the description itself is not intended to necessarily limit the scope of claims. Rather, the claimed subject matter might be embodied in other ways to include different steps or combinations of steps similar to the ones described in this document, in conjunction with other present or future technologies. The following discussion and accompanying figures disclose various apparel systems, articles of apparel, and protective components that may be incorporated into the apparel systems or articles of apparel.

Apparel System

Figure 1:
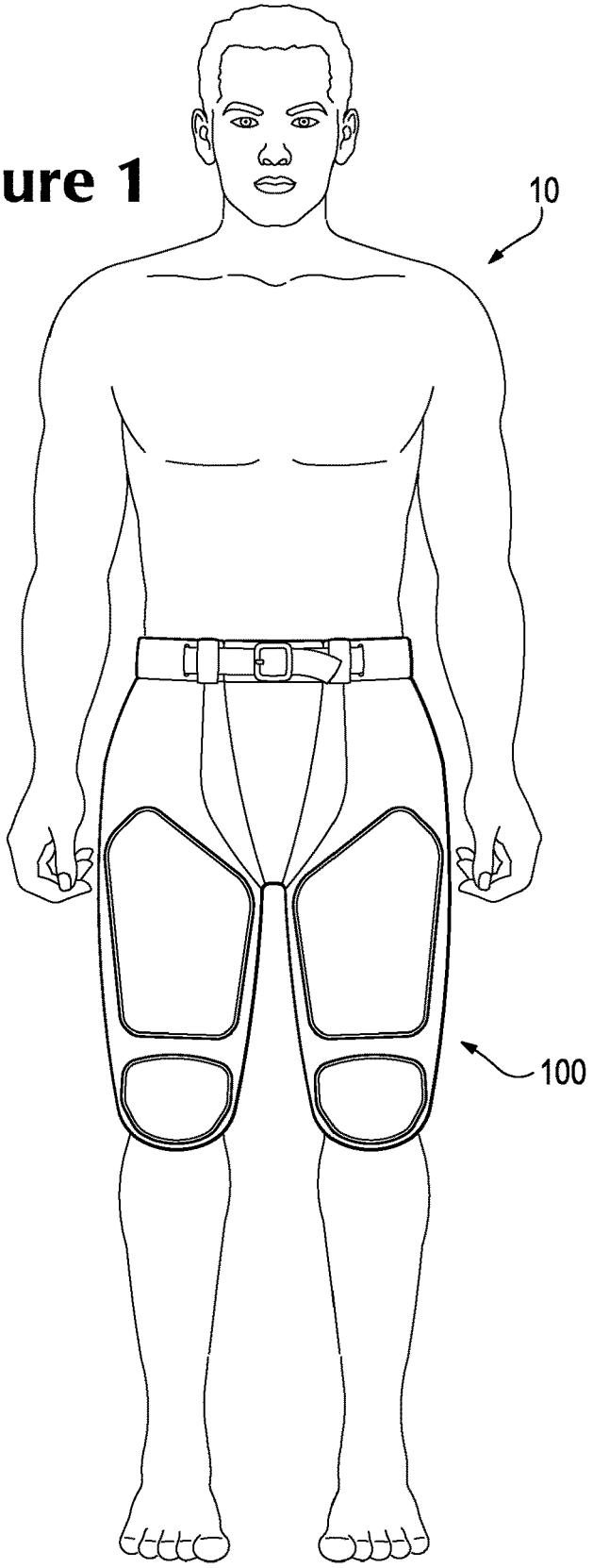
FIG. 1 is a front elevational view of an individual wearing an apparel system having an outer garment and an inner garment.
Figure 2:
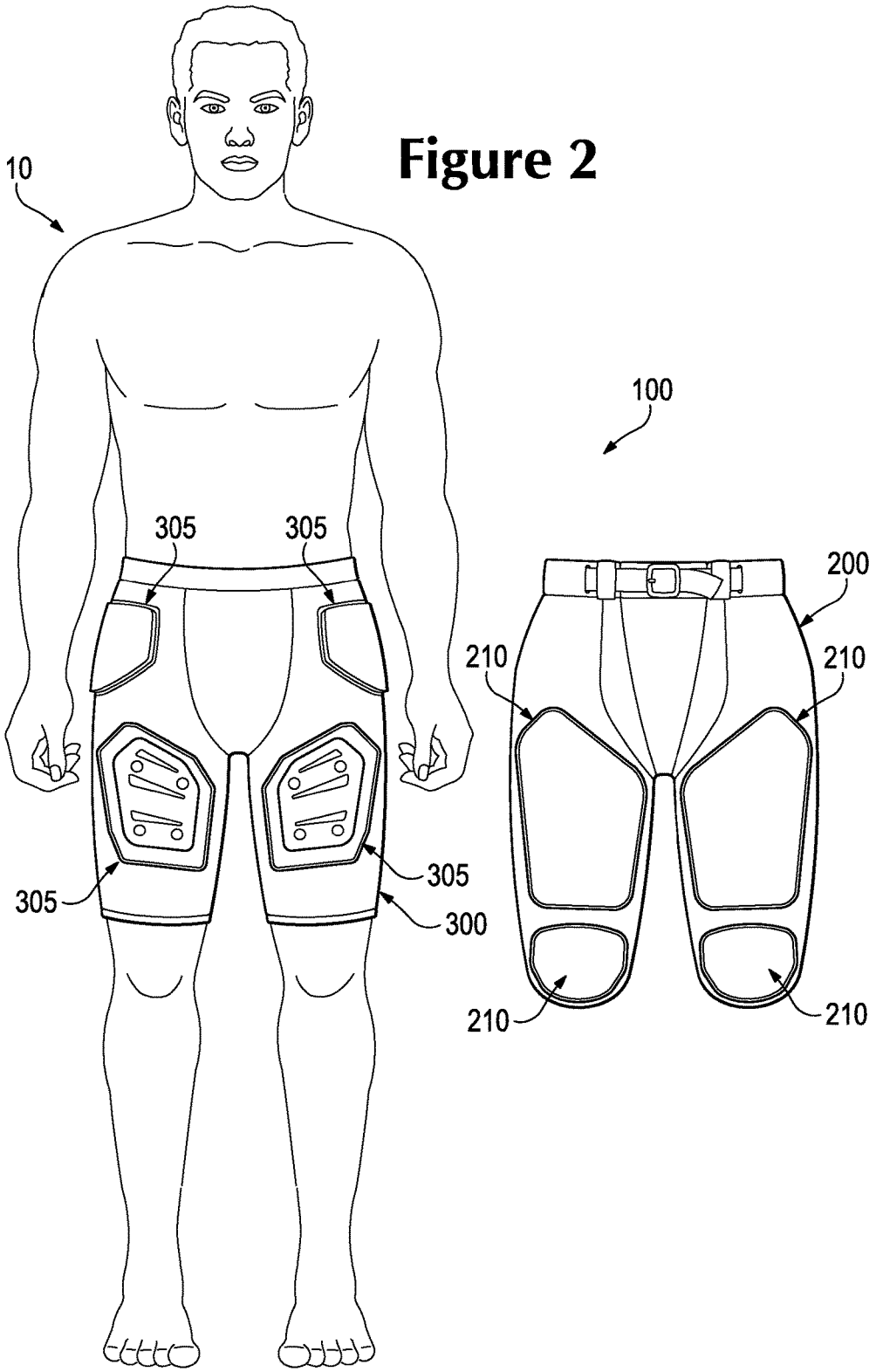
FIG. 2 is an exploded front elevational view of the individual wearing the apparel system.
Figure 3:
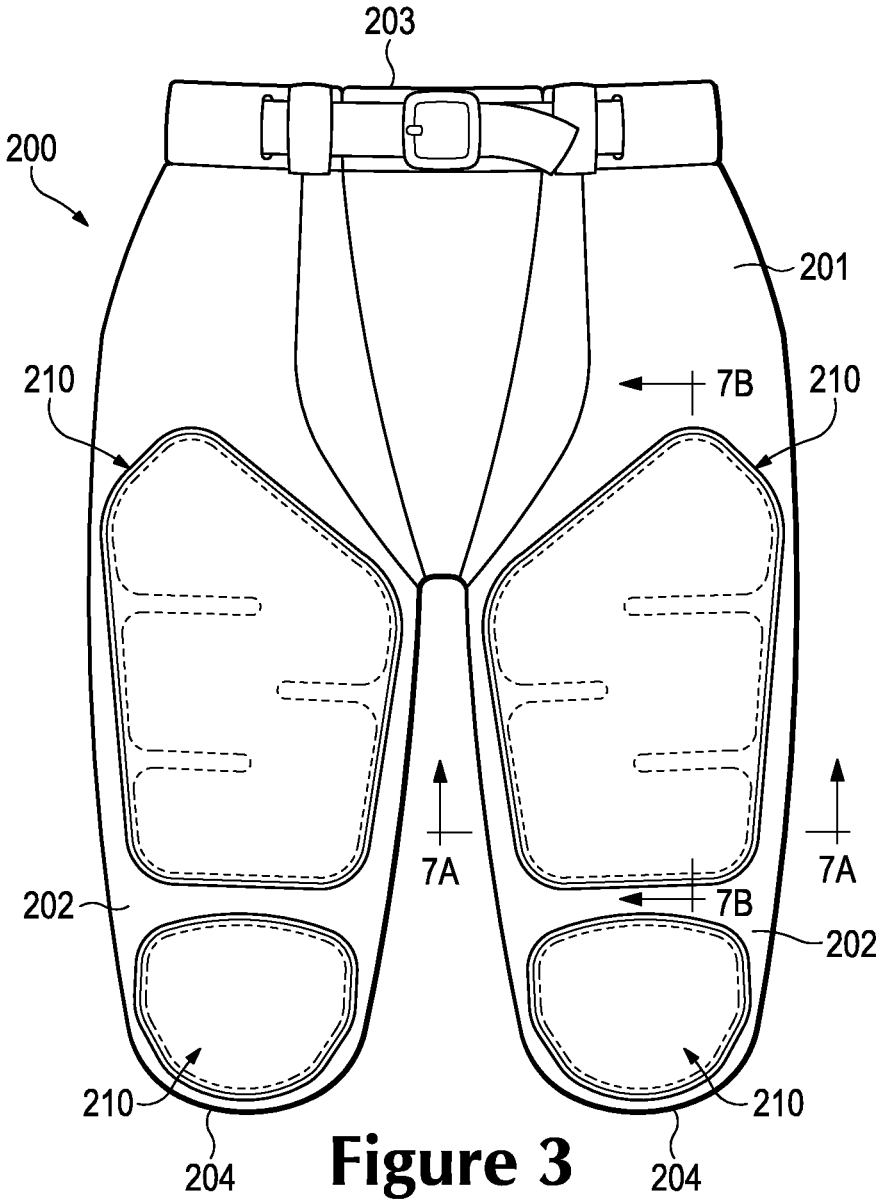
FIG. 3 is a front elevational view of the outer garment.
Figure 4:
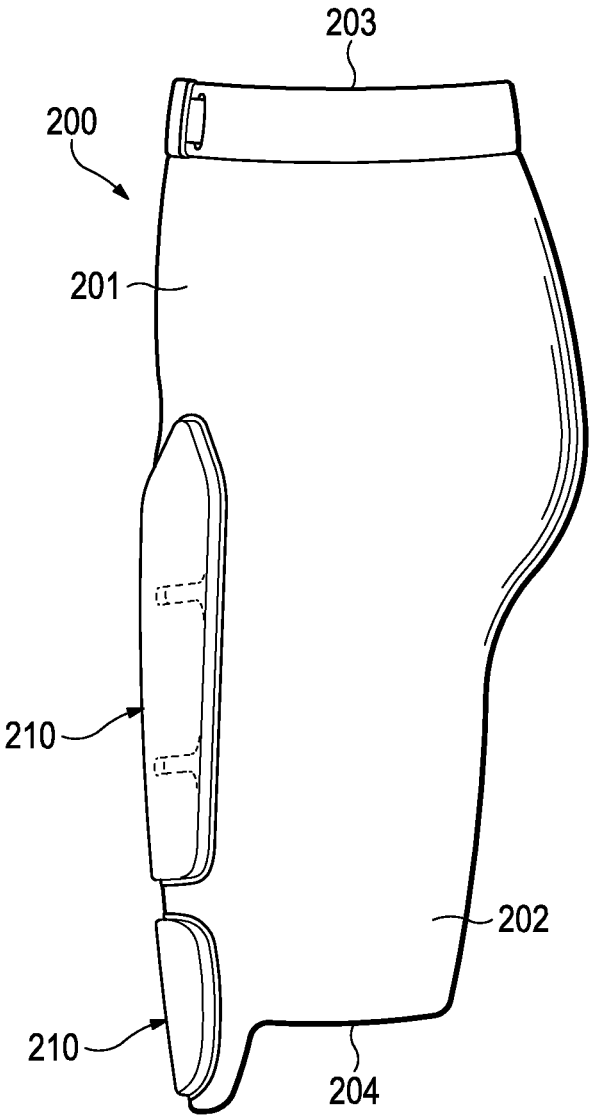
FIGS. 4 and 5 are side elevational views of the outer garment.
Figure 5:
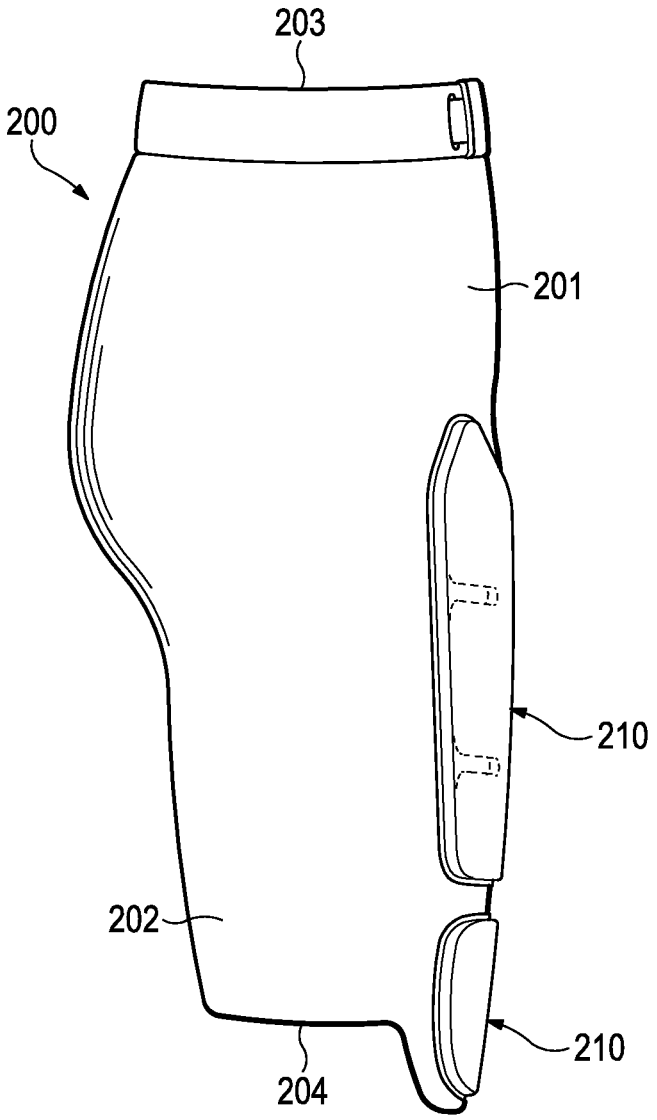
Figure 6:
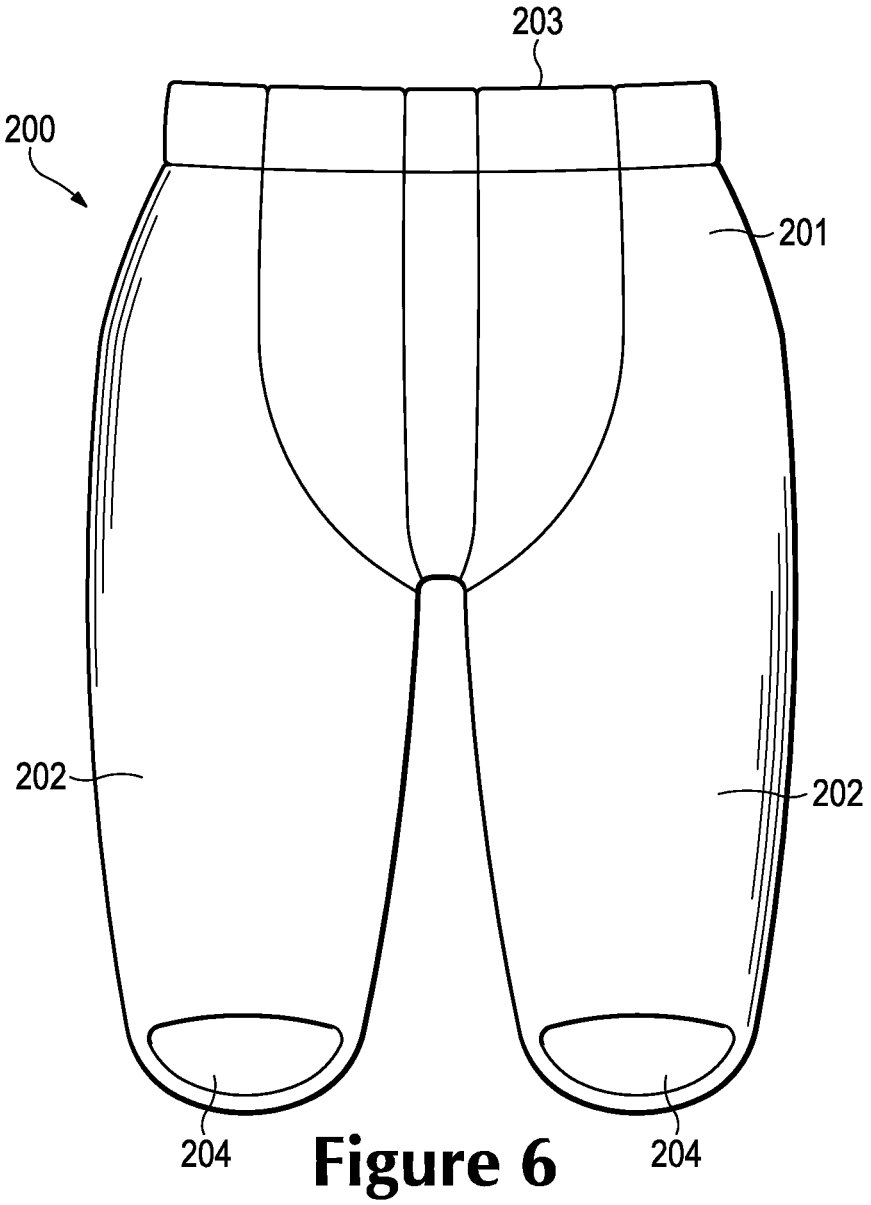
FIG. 6 is a rear elevational view of the outer garment.

With reference to FIGS. 1 and 2, an individual 10 is depicted as wearing an apparel system 100 that includes an outer garment 200 and an inner garment 300. Each of garments 200 and 300 exhibit the general configuration of a pants-type garment, which includes any of a plurality of articles of apparel that cover a portion of a pelvic area of individual 10 and may extend over legs of individual 10. Although garments 200 and 300 are each depicted as being pairs of shorts, various concepts disclosed below for garments 200 and 300 may also be applied to other pants-type garments, including pants, briefs, jeans, and underwear. The various concepts disclosed below for garments 200 and 300 may also be applied to shirt-type garments, which cover a portion of a torso area of individual 10 and may extend over arms of individual 10. Examples of shirt-type garments include long-sleeved shirts, short-sleeved shirts, tank tops, undershirts, jackets, and coats. In some configurations, articles of apparel incorporating concepts disclosed below for garments 200 and 300 may be combinations of shirt-type garments and pants-type garments, including bodysuits, leotards, unitards, and wetsuits. In addition, articles of apparel incorporating concepts disclosed below for garments 200 and 300 may have configurations that cover other areas of individual 10, such as hats, helmets, arm and leg wraps, gloves, socks, and footwear, for example.

Although apparel system 100 may be worn alone or exposed, apparel system 100 may also be worn in combination with other articles of apparel (e.g., under or over other articles of apparel). Apparel system 100 may also be worn in combination with other pieces of equipment (e.g., athletic or protective equipment). In general, outer garment 200 is worn over inner garment 300, thereby positioning outer garment 200 to be exterior of inner garment 300. Whereas inner garment 300 may be worn in contact with and to cover individual 10, outer garment 200 may be worn in contact with and to cover inner garment 300. That is, inner garment 300 is generally positioned between individual 10 and outer garment 200. Depending upon various factors (e.g., sport, activity, weather, preferences), the other articles of apparel or pieces of equipment may be worn (a) between inner garment 300 and individual 10, (b) between garments 200 and 300, or (c) exterior of outer garment 200. Accordingly, the configuration of apparel system 100, including each of the individual garments 200 and 300, and the manner in which apparel system 100 is worn by individual 10 may vary significantly.

Apparel system 100 incorporates various cover components 210 and protective components 305. More particularly, outer garment 200 includes cover components 210, and inner garment 300 includes protective components 305. Although cover components 210 and protective components 305 may each be utilized individually to impart padding, cushioning, or otherwise distribute or attenuate impact forces, thereby imparting protection to individual 10, components 210 and 305 may also operate cooperatively to impart protection to individual 10. For example, some cover components 210 may overlap, extend over, or otherwise coincide with the positions of some protective components 305. In areas where cover components 210 extend over protective components 305, both elements 210 and 305 may impart protection to individual 10. Additional details concerning garments 200 and 300, as well as components 210 and 305, will be discussed below.

Outer Garment Configuration

Outer garment 200, which incorporates cover components 210, is depicted individually in FIGS. 3-6 as including a pelvic region 201 and a pair of leg regions 202 that extend outward and downward from pelvic region 201. Pelvic region 201 corresponds with the pelvic area of individual 10 and extends over at least a portion of the pelvic area when worn. An upper portion of pelvic region 201 defines a waist opening 203 that extends around a waist of individual 10 when outer garment 200 is worn. Leg regions 202 correspond with a right leg and a left leg of individual 10 and cover at least a portion of the right leg and the left leg when worn. Lower portions of leg regions 202 each define a thigh opening 204 that extends around a thigh of individual 10 when outer garment 200 is worn.

Cover components 210 are incorporated into various areas of outer garment 200 to impart padding, cushioning, or otherwise attenuate impact forces, thereby imparting protection to individual 10. Two lower cover components 210 are located in a front area of leg regions 202 and adjacent to thigh openings 204, and two upper cover components 210 are also located in the front area of leg regions 202 and extend upward and into lower areas of pelvic region 201. As discussed above, cover components 210 may overlap, extend over, or otherwise coincide with the positions of some protective components 305 of inner garment 300. Whereas the upper cover components 210 coincide in location and extend over two of protective components 305, the lower cover components 210 are positioned separate from protective components 305. In this configuration, the upper cover components 210 and two of protective components 305 cooperatively impart protection to areas of individual 10, while the lower cover components 210 individually impart protection to areas of individual 10. In further configurations of apparel system 100 or outer garment 200, cover components 210 may be positioned in various areas of outer garment 200, including the sides or back of leg regions 202 or in pelvic region 201, to protect specific portions (e.g., muscles, bones, joints, impact areas) of individual 10. Additionally, the quantity, shapes, sizes, and other properties of cover components 210, as well as the materials utilized in cover components 210, may vary significantly to provide a particular level of protection to the specific portions of individual 10.

Figure 7A:
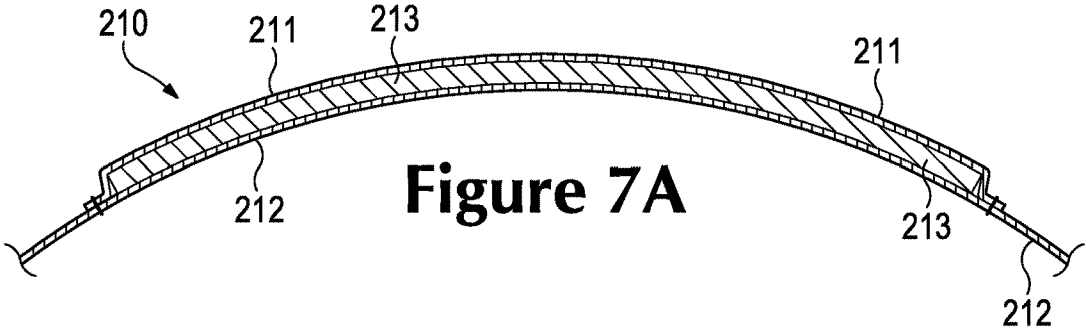
FIGS. 7A and 7B are cross-sectional views of the outer garment, as defined by section lines 7A and 7B in FIG. 3.
Figure 7B:
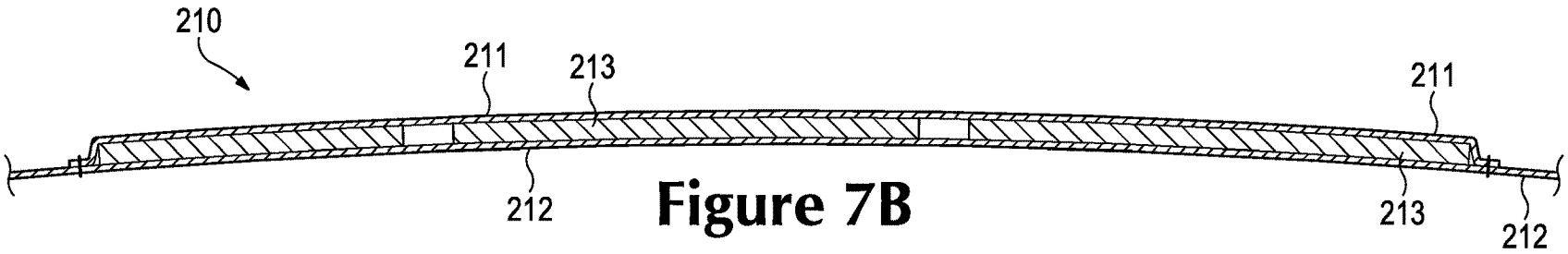
Figure 8:
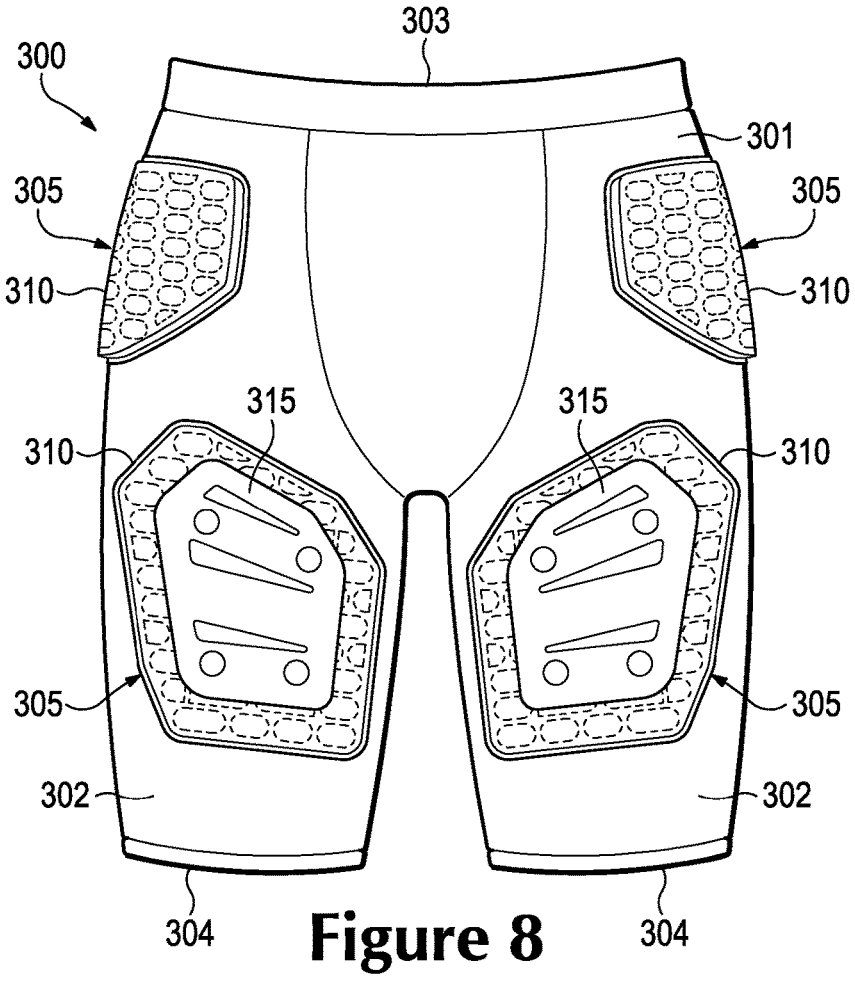
FIG. 8 is a front elevational view of the inner garment.
Figure 9:
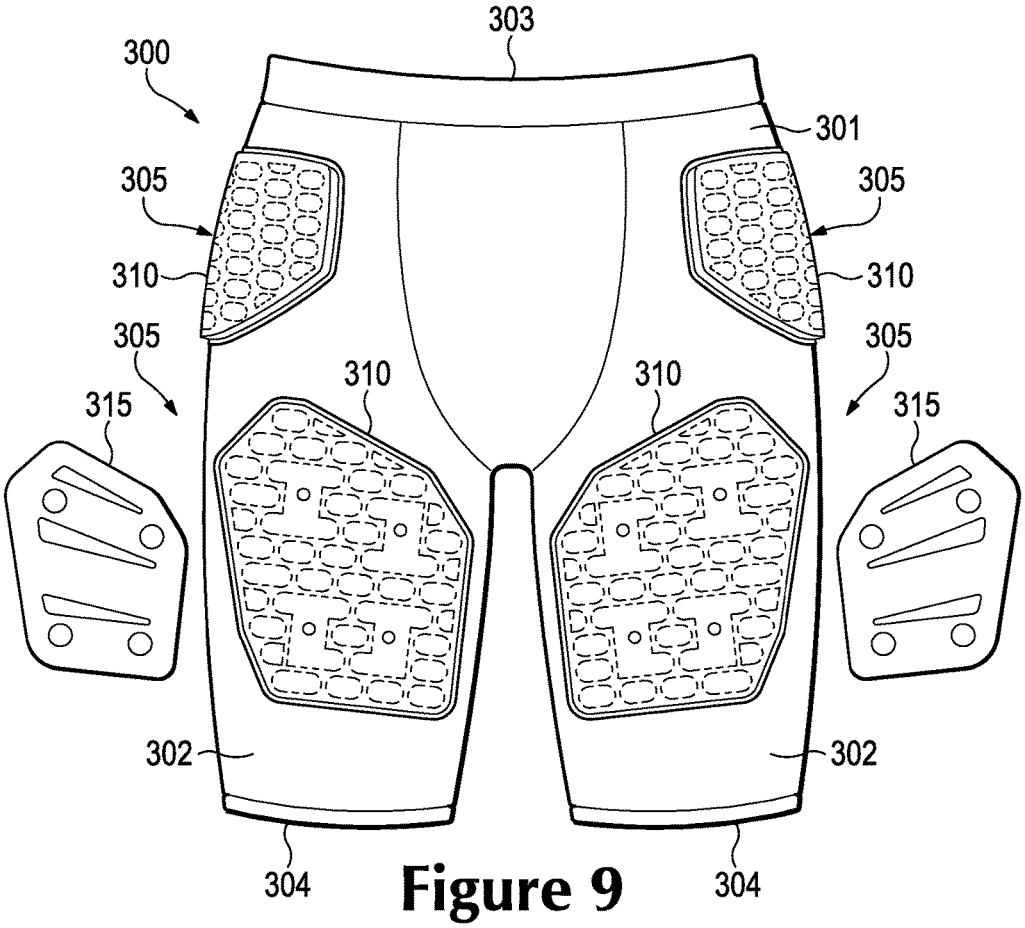
FIG. 9 is an exploded front elevational view of the inner garment.
Figure 10:
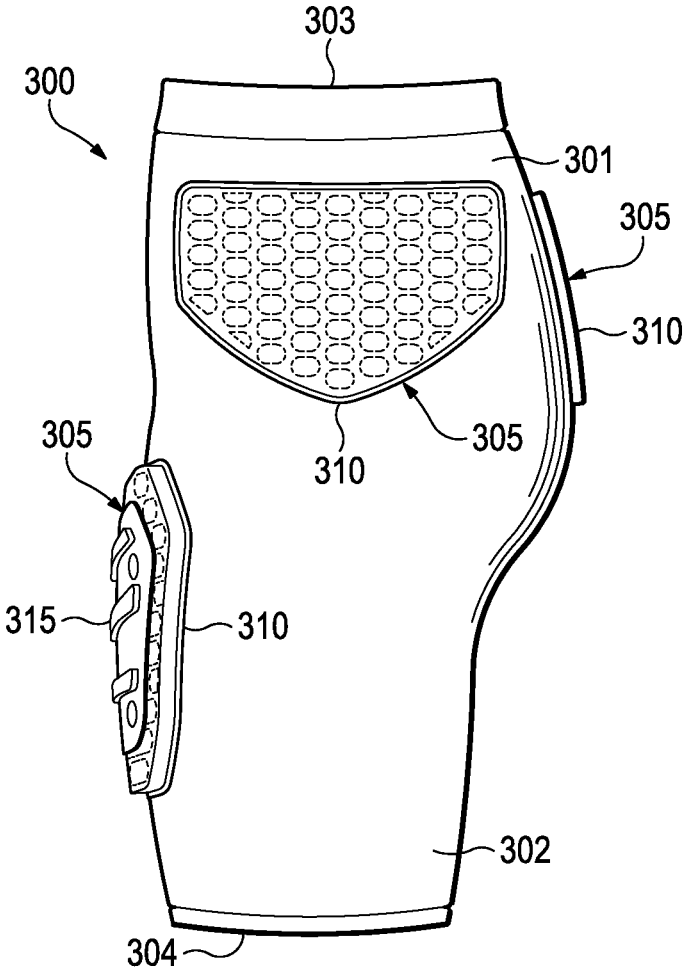
FIGS. 10 and 11 are side elevational views of the inner garment.
Figure 11:
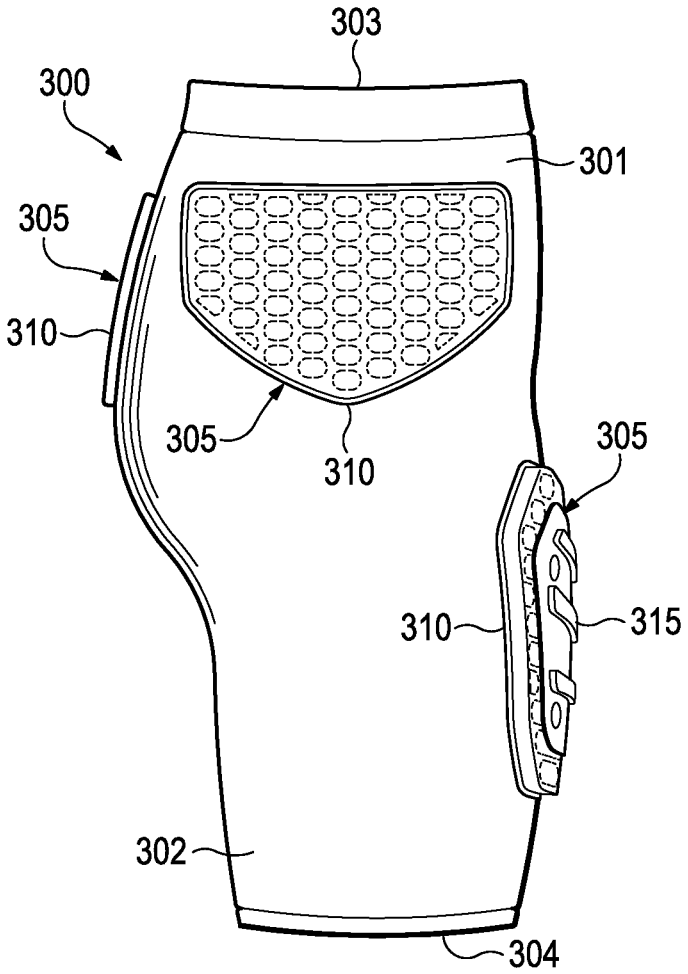
Figure 12:
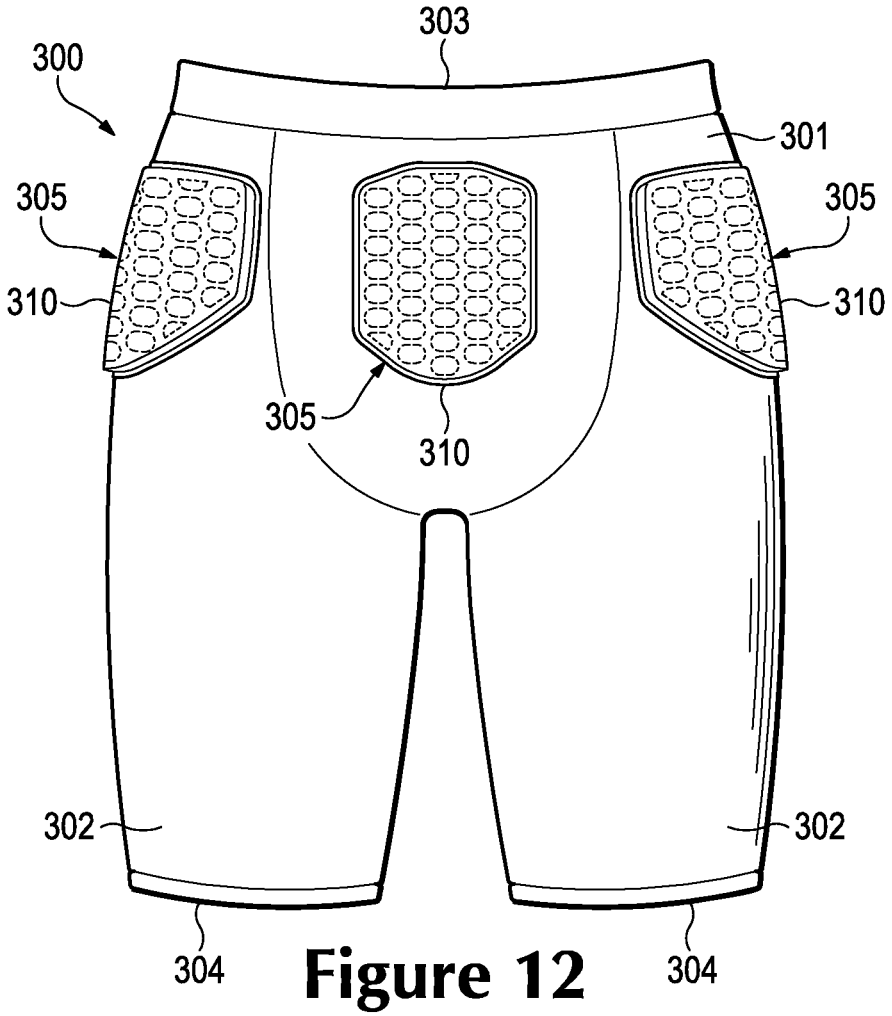
FIG. 12 is a rear elevational view of the inner garment.
Figure 13:
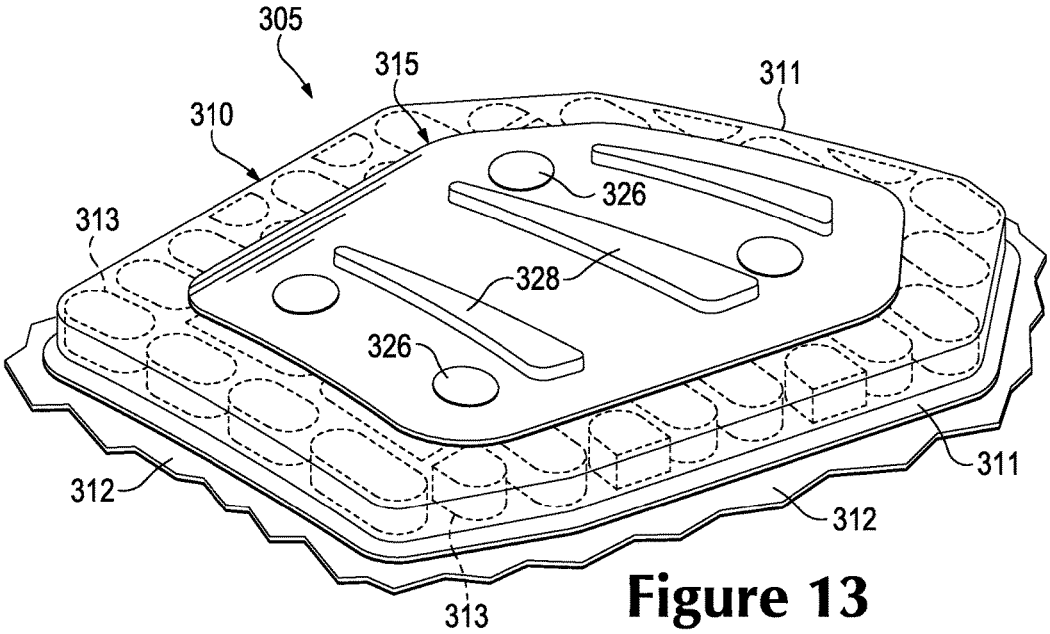
FIG. 13 is a perspective view of a protective component of the inner garment.
Figure 14:
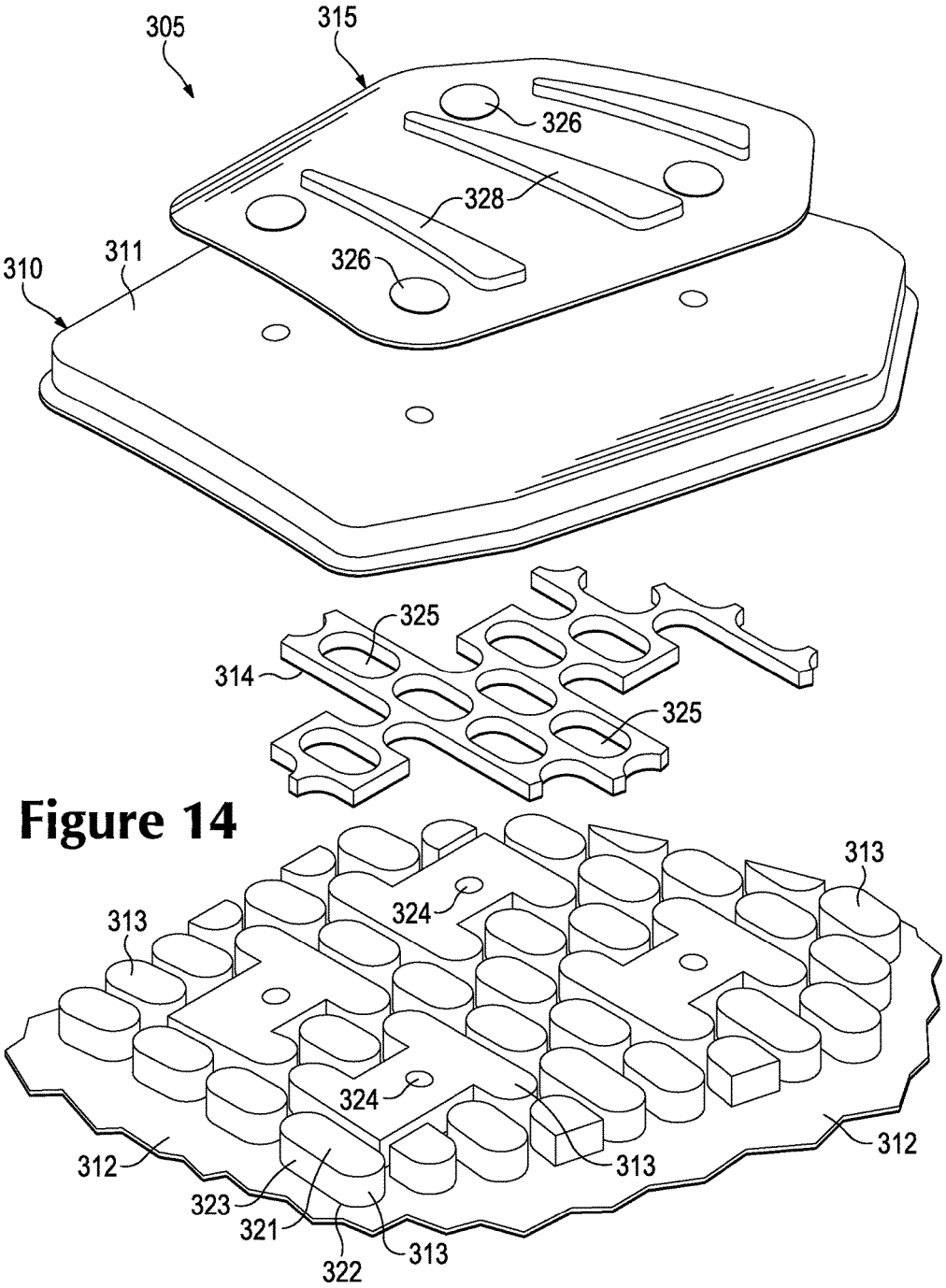
FIG. 14 is an exploded perspective view of the protective component.
Figure 15:
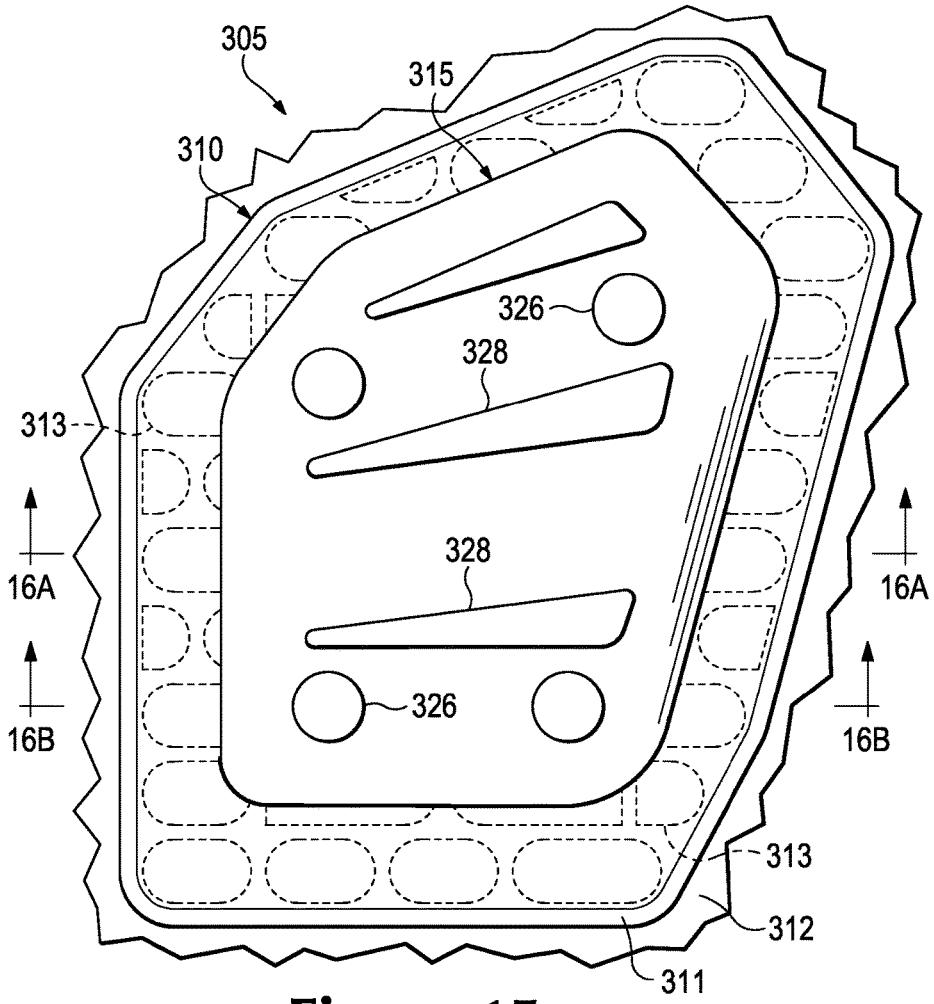
FIG. 15 is a top plan view of the protective component.

One of cover components 210 is depicted in the cross-sectional views of FIGS. 7A and 7B as including a first material layer 211, a second material layer 212, and a pad 213. In general, pad 213 is positioned between and secured to first material layer 211 and second material layer 212. Material layers 211 and 212 cooperatively form an outer surface or covering for protective elements 210. That is, material layers 211 and 212 cooperatively form a pocket or void, in which pad 213 is located. Whereas second material layer 212 is depicted as having a generally planar configuration, first material layer 211 extends over pad 213 and also along sides of pad 213 to join with second material layer 212 (e.g., through stitching, an adhesive, or thermal bonding). Although cover component 210 may be incorporated into outer garment 200 in a variety of ways, first material layer 211 may be positioned exterior of second material layer 212. That is, first material layer 211 may form a portion of an exterior surface of outer garment 200, whereas second material layer 212 may form a portion of an interior surface of outer garment 200. An advantage to this configuration is that cover component 210 protrudes outward from outer garment 200, rather than protruding inward and toward individual 10. In some configurations of outer garment 200, however, cover component 210 may protrude inward.

A thickness of pad 213 may vary depending upon various factors, including the type of material utilized for pad 213 and the desired level of protection. In general, however, the thickness of pad 213 may range from one to fifty millimeters or more when formed from a polymer foam material. Although pad 213 may exhibit a constant thickness between material layers 211 and 212, the thickness may vary across the width of pad 213. For example, edges of pad 213 may be thinner than central areas of pad 213. Various apertures, gaps, and indentations may also be formed in pad 213 to enhance flexibility and breathability.

A variety of materials may be utilized for first material layer 211 and second material layer 212, including various textiles, polymer sheets, leather, or synthetic leather, for example. Combinations of these materials (e.g., a polymer sheet bonded to a textile) may also be utilized for material layers 211 and 212. Although material layers 211 and 212 may be formed from the same material, each of material layers 211 and 212 may also be formed from different materials. With regard to textiles, material layers 211 and 212 may be formed from knitted, woven, or non-woven textile elements that include rayon, nylon, polyester, polyacrylic, cotton, wool, or silk, for example. Moreover, the textiles may be non-stretch, may exhibit one-directional stretch, or may exhibit multi-directional stretch. Accordingly, a variety of materials are suitable for first material layer 211 and second material layer 212. As will be described in other part of this Detailed Description, material layers of the inner garment 300 may include one or more layers that are similar to the material layers of the outer garment or that include materials described with respect to the material layers of the outer garment.

Pads 213 may also be formed from a variety of materials, including various polymer foam materials that return to an original shape after being compressed. As an alternative to polymer foam materials, pads 213 may also be formed as fluid-filled chambers. Examples of suitable polymer foam materials for pads 213 include polyurethane, ethylvinylacetate, polyester, polypropylene, and polyethylene foams. Moreover, both thermoplastic and thermoset polymer foam materials may be utilized. In some configurations of cover components 210, pads 213 may be formed from a polymer foam material with a varying density, or solid polymer or rubber materials may be utilized. Also, different pads 213 may be formed from different materials, or may be formed from similar materials with different densities. Additional articles of apparel having features that may be utilized in outer apparel 200 or for pads 213 are disclosed in U.S. patent application Ser. No. 11/620,950, filed 8 Jan. 2007 and entitled Athletic Garment With Articulated Body Protective Underlayer, which is entirely incorporated herein by reference.

The polymer foam materials forming pads 213 of cover components 210 attenuate impact forces to provide protection. When incorporated into apparel system 100 and outer garment 200, the polymer foam materials of pads 213 may compress to protect a wearer from contact with other athletes, equipment, or the ground. Accordingly, cover components 210 may be utilized to provide protection to areas of individual 10 that are covered by cover component 210. As discussed above, cover components 210 may overlap, extend over, or otherwise coincide with the positions of some protective components 305 of inner garment 300. In this position, cover components 210 may be utilized to provide protection to other athletes or individuals from relatively hard or rigid materials (e.g., a plate) incorporated into protective components 305. As will be described in other part of this Detailed Description, a pad of the inner garment 300 may include aspects similar to the elements described with respect to the pad(s) of the outer garment.

Inner Garment Configuration

Inner garment 300, which incorporates protective components 305, is depicted individually in FIGS. 8-12 as including a pelvic region 301 and a pair of leg regions 302 that extend outward or downward from pelvic region 301. Pelvic region 301 corresponds with the pelvic area of individual 10 and extends over at least a portion of the pelvic area when worn. Pelvic region 301 also corresponds with pelvic region 201 of outer garment 200 and is generally located between pelvic region 201 and individual 10 when worn. An upper portion of pelvic region 301 defines a waist opening 303 that extends around a waist of individual 10 when outer garment 300 is worn. Leg regions 302 correspond with a right leg and a left leg of individual 10 and cover at least a portion of the right leg and the left leg when worn. Leg regions 302 also correspond with leg regions 202 of outer garment 200 and are generally located between leg regions 202 and individual 10 when worn. Lower portions of leg regions 302 each define a thigh opening 304 that extends around a thigh of individual 10 when inner garment 300 is worn.

Protective components 305 are incorporated into various areas of inner garment 300 to impart padding, cushioning, or otherwise attenuate impact forces, thereby imparting protection to individual 10. More particularly, two of protective components 305 are located in a front area of leg regions 302, two of protective components 305 are located on sides of pelvic region 301, and one of protective components 305 is in a back of pelvic region 301. In further configurations of apparel system 100 or inner garment 300, protective components 305 may be positioned in various areas of inner garment 300, including the sides or back of leg regions 302 or other areas of pelvic region 301, to protect specific portions (e.g., muscles, bones, joints, impact areas) of individual 10. Additionally, the quantity, shapes, sizes, and other properties of protective components 305, as well as the materials utilized in protective components 305, may vary significantly to provide a particular level of protection to the specific portions of individual 10.

As discussed above, cover components 210 of outer garment 200 may overlap, extend over, or otherwise coincide with the positions of some protective components 305. Although outer garment 200 may cover substantially all of inner garment 300 and the various protective components 305, only the upper cover components 210 coincide in location and extend over the two protective components 305 in the front area of leg regions 302. In further configurations of apparel system 100, however, additional cover components 210 may extend over other protective components 305.

Protective Element Configurations

An example configuration for one of protective components 305 is depicted in FIGS. 13-17B as including a cushioning element 310 and a plate element 315. Cushioning element 310 includes a first material layer 311, a second material layer 312, a plurality of pads 313, a frame 314, and a plate element 315. In general, pads 313 and frame 314 are positioned between first material layer 311 and second material layer 312. Although pads 313 are secured to first material layer 311 and second material layer 312, frame 314 is unsecured to each of first material layer 311, second material layer 312, and pads 313. Additionally, plate element 315 is located at an exterior of cushioning element 310 (i.e., located exterior of first material layer 311). Although each cushioning element 310 in the front area of leg regions 302 incorporate one of plate elements 315, further plates are absent from other cushioning elements 310. In further configurations, additional plate elements 315 may be utilized in the other cushioning elements 310.

First material layer 311 and second material layer 312 cooperatively form an outer surface or covering for cushioning element 310, with plate element 315 being secured to the outer surface. That is, first material layer 311 and second material layer 312 cooperatively form a pocket or void, in which pads 313 and frame 314 are located. Whereas second material layer 312 is depicted as having a generally planar configuration, first material layer 311 extends over pads 313 and frame 314 and also along sides of pads 313 to join with second material layer 312 (e.g., through stitching, an adhesive, or thermal bonding). Although cushioning element 310 may be incorporated into inner garment 300 in a variety of ways, first material layer 311 may be positioned exterior of second material layer 312. That is, first material layer 311 may form a portion of an exterior surface of inner garment 300, whereas second material layer 312 may form a portion of an opposite interior surface of inner garment 300. An advantage to this configuration is that cushioning element 310 protrudes outward from inner garment 300, rather than protruding inward and toward individual 10. In some configurations of inner garment 300, however, cushioning element 310 may protrude inward.

Any of the various materials discussed above for material layers 211 and 212 may be utilized for first material layer 311 and second material layer 312. For example, the second material layer 312 may include part of a base layer that forms at least part of the inner garment 300. Alternatively, second material layer 312 may be an additional layer that is coupled to an outward-facing surface of the inner garment 300, such as by stitching, bonding, adhering, welding, etc. In a further aspect, the second material layer 312 includes a knitted, woven, or non-woven textile that at least partially includes rayon, nylon, polyester, polyacrylic, cotton, wool, or silk, for example. Moreover, the textiles of second material layer 312 may be non-stretch, may exhibit one-directional stretch, or may exhibit multi-directional stretch. In a further aspect, the first material layer 311 may be either the same material as the second material layer 312 or a material that is different from the second material layer 312. For example, the first material layer 311 may include a textile that is perforated (e.g., mesh) to provide added ventilation and breathability. The first material layer 311 may also include a polymer sheet, such as a thermoplastic sheet (e.g., thermoplastic polyurethane) that is affixable to the second material layer 312 and to the pad 313.

Pads 313 are located between and secured to each of material layers 311 and 312. Each of pads 313 has a first surface 321 secured to first material layer 311, an opposite second surface 322 secured to second material layer 312, and a side surface 323 that extends between surfaces 321 and 322. Although the shapes of pads 313 may vary significantly, many of surfaces 321 and 322 are depicted as having an elliptical or generally elongate shape with rounded end areas, and side surface 323 extends in a generally straight fashion between surfaces 321 and 322. Pads 313 are spaced evenly from each other and arranged in offset rows.

The pads 313 are generally depicted in some of the figures as discrete elements that are spaced from each other, but the pad elements may also be connected or formed as a one-piece unit. That is, in an aspect of the present invention, a plurality of the pads 313 are connected to another to form a single, integrated pad. For example, a single, integrated pad may be cast (e.g., from a polymer foam), or otherwise molded, to include a plurality connected pads 313. In another aspect, a single sheet of padding material might be routered, milled, heat pressed, or manufactured using some other subtractive manufacturing technique in order to create grooves or reduced-thickness portions between the pads 313.

Given that cushioning element 310 is depicted as having a generally pentagonal configuration, various pads 313 around a perimeter of cushioning element 310 exhibit a truncated or partial configuration. Some of pads 313 also define apertures 324 that receive elements for securing plate element 315, and these pad components may be larger than other pad components 315. A variety of materials may be utilized for pads 313, including any of the various materials discussed above for pad 213, such as polymer foam materials and fluid-filled chambers.

Each of pads 313 are depicted as having the same thickness (i.e., distance between surfaces 321 and 322), which may range from one to fifty millimeters or more when formed from a polymer foam material. As an alternative, pads 313 may exhibit varying thicknesses. For example, a group of pads 313 located in a central area of cushioning element 310 may exhibit a maximum thickness, a group of pads 313 located around the central area may exhibit a medium thickness, and a group of pads 313 located adjacent to a periphery of cushioning element 310 may exhibit a minimum thickness. A configuration of a cushioning element with varying thicknesses is disclosed in U.S. Provisional Patent Application Ser. No. 61/158,653, filed 9 Mar. 2009 and entitled Cushioning Elements For Apparel And Other Products, which is entirely incorporated herein by reference.

Frame 314 is located between each of material layers 311 and 312. In contrast with pads 313, frame 314 is unsecured to each of first material layer 311 and second material layer 312, and frame 314 is also unsecured to pads 313. This configuration permits frame 314 to float or otherwise move relative to first material layer 311, second material layer 312, and pads 313. Frame 314 defines a plurality of apertures 325 having the general shape of pads 313. Given this configuration, frame 314 extends around and between various pads 313. In areas where frame 314 is present, the combination of pads 313 and frame 314 effectively forms a foam layer within cushioning element 310. Although the dimensions of apertures 325 may substantially match the dimensions of pads 313, frame 314 may also be formed such that a gap extends between edges of apertures 325 and side surfaces 233 of pads 313. Any of the variety of materials discussed above as being suitable for pads 213 and 313 may also be utilized for frame 314.

Frame 314 is depicted as being located in the central area of cushioning element 310. As an alternative, frame 314 may extend (a) throughout cushioning element 310 and define apertures 325 that extend around all of pads 313, (b) around other pads 313, or (c) through other areas of cushioning element 310. Additionally, frame 314 may extend to the periphery of cushioning element 310 in some areas, but not in other areas. Accordingly, the portions of cushioning element 310 into which frame 314 extends may vary significantly.

Figure 16A:
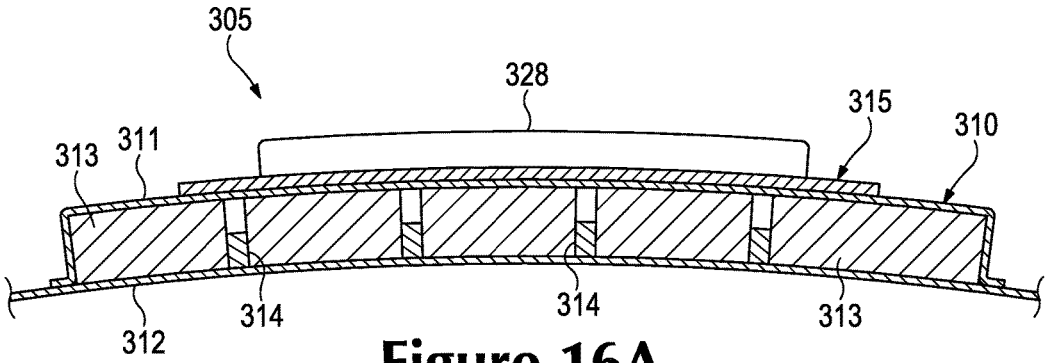
FIGS. 16A and 16B are cross-sectional views of the protective component, as defined by section lines 16A and 16B in FIG. 15.
Figure 16B:
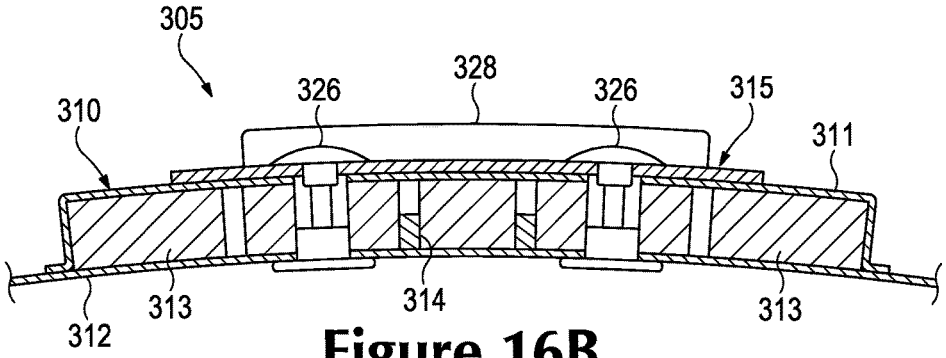
Figure 17A:
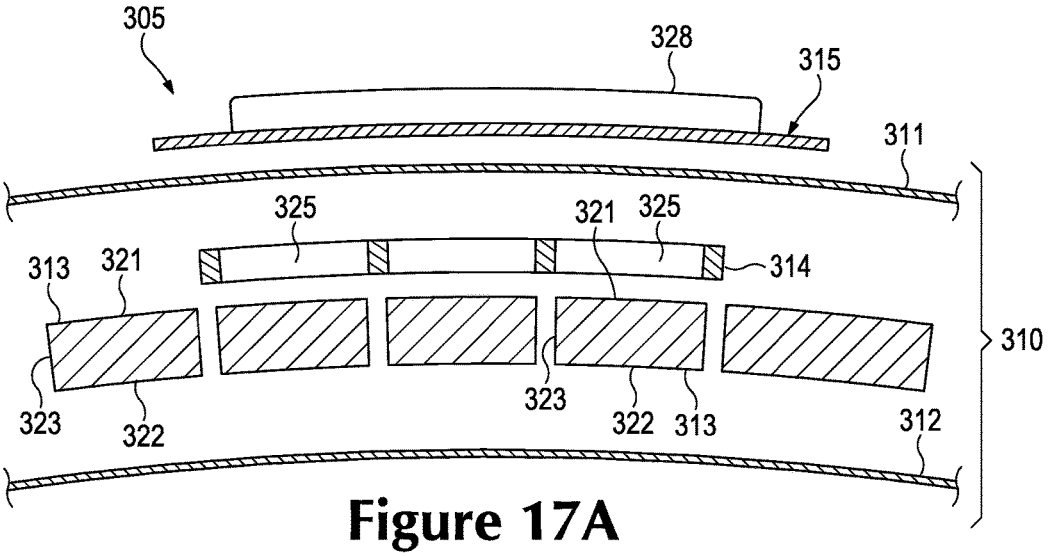
FIGS. 17A and 17B are exploded cross-sectional views respectively corresponding with the cross-sectional views of FIGS. 16A and 16B.
Figure 17B:
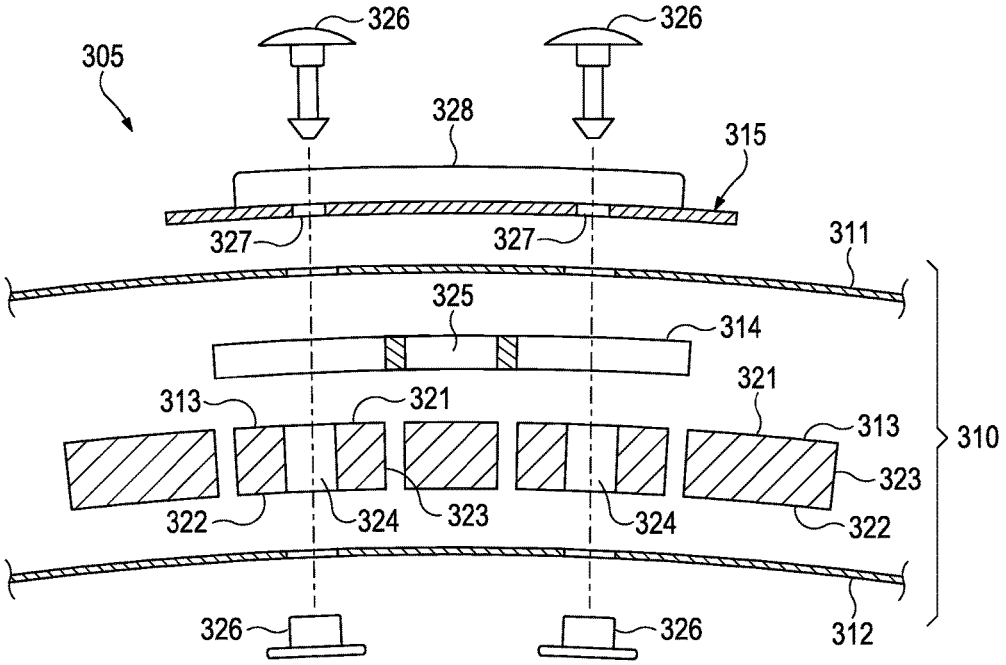

Referring to the cross-sectional views of FIGS. 16A and 16B, for example, frame 314 is depicted as exhibiting lesser thickness than each of pads 313. An advantage of this configuration is that frame 314 may move relative to material layers 311 and 312, thereby enhancing the flexibility of cushioning element 310. As an example, frame 314 may have a thickness of approximately two millimeters in a configuration wherein the pads 313 exhibit a thickness of five millimeters. In other configurations, the thickness of frame 314 may range from one to fifty millimeters or more. Although frame 314 may exhibit lesser thickness than pads 313, frame 314 may also be thicker than pads 313.

A variety of methods may be utilized to manufacture cushioning element 310. In general, the methods include bonding (e.g., adhesive or thermal bonding) each of pads 313 to material layers 311 and 312. Examples of suitable manufacturing processes are disclosed in (a) U.S. patent application Ser. No. 12/755,579, which was filed in the U.S. Patent and Trademark Office on 7 Apr. 2010 and entitled Method Of Manufacturing Cushioning Elements For Apparel And Other Products; (b) U.S. patent application Ser. No. 13/035,570, which was filed in the U.S. Patent and Trademark Office on 25 Feb. 2011 and entitled Cushioning Elements For Apparel And Other Products And Methods Of Manufacturing The Cushioning Elements; and (c) U.S. patent application Ser. No. 13/035,592, which was filed in the U.S. Patent and Trademark Office on 25 Feb. 2011 and entitled Articles Of Apparel Incorporating Cushioning Elements And Methods Of Manufacturing The Articles Of Apparel, each of which are entirely incorporated herein by reference.

Plate element 315 is positioned exterior of material layers 311 and 312, pads 313, and frame 314. Whereas pads 313 and frame 314 are located between material layers 311 and 312, plate element 315 is located on an opposite side of first material layer 311 and forms a portion of an exterior surface of inner garment 300 and protective component 305. As described in greater detail below, plate element 315 has a semi-rigid structure that distributes impact forces over pads 313 to impart protection to individual 10 or another wearer.

Various securing elements 326 are utilized to secure plate element 315 to cushioning element 310. Securing elements 326 extend through apertures 327 in plate element 315 and also extend through corresponding apertures 324 in selected pads 313, as well as holed in material layers 311 and 312. Although securing elements 326 are depicted as having the general configuration of rivets, various snap-fit securing mechanisms, adhesive or thermal bonding, or stitching may be utilized to join plate element 315. In some configurations, plate element 315 may also be secured with a hook-and-loop fastener that permits plate element 315 to be separated, repositioned, or replaced.

Plate element 315 has an overall curved configuration that generally conforms with a shape of individual 10. Given that protective component 305 may be utilized to protect a thigh of individual 10, plate element 315 may exhibit a curvature that corresponds with the thigh. Additionally, plate element 315 may include various ribs 328 that enhance rigidity. In further configurations, plate element 315 may have a variety of other features that enhance the comfort or protective properties of apparel system 100 or protective component 305. For example, plate element 315 may define a plurality of apertures that enhance breathability or flexibility, plate element 315 may be formed from multiple materials that vary the rigidity or flexibility in different areas, or plate element 315 may have a varying thickness that also vary the rigidity or flexibility in different areas.

Plate element 315 is depicted as having lesser area than first material layer 211. In this configuration, some of pads 313 are located adjacent to plate element 315 (i.e., covered by plate element 315), and some of pads 313 are located around a periphery of plate element 315. That is, plate element 315 only covers a central portion of pads 313, but effectively exposes peripheral portions of pads 313. Forming plate element 315 in this manner imparts a varying thicknesses to cushioning element 310. An advantage of thee varying thicknesses relates to the comfort of apparel system 100 and the integration of inner garment 300 with other articles of apparel (e.g., outer garment 200) or other articles of equipment. The lesser thickness of the periphery of cushioning element 310 imparts a lower profile at the periphery. Given the lower profile, portions of cushioning element 310 at the periphery may be less noticeable to individual 10 and may interfere less with the other articles of apparel or equipment. Moreover, plate element 315 may have a conventional size, but the protective properties of pads 313 may extend beyond plate element 315 to cover further and larger areas of individual 10.

As a comparison with the compressible polymer foam material forming pads 313 and frame 314, plate element 315 may be formed from a semi-rigid or rigid polymer material with greater stiffness and density than the polymer foam material. As another comparison, whereas pads 313 and frame 314 may be formed from a polymer foam material, plate element 315 may include a non-foamed polymer material. Examples of suitable polymer materials for plate element 315 include polyethylene, polypropylene, acrylonitrile butadiene styrene, polyester, thermoset urethane, thermoplastic urethane, polyether block amide, polybutylene terephthalate various nylon formulations, or blends of these materials. Composite materials may also be formed by incorporating glass fibers, aramid fibers, or carbon fibers, for example, into the polymer materials discussed above in order to enhance the strength and rigidity of plate element 315. In some configurations, plate element 315 may also be formed from metal materials (e.g., aluminum, titanium, steel) or may include metal elements that enhance the strength and rigidity of plate element 315. Accordingly, a variety of materials may be utilized for plate element 315.

Cushioning element 310 and plate element 315 cooperatively impart protection to individual 10. An impact force contacting plate element 315, for example, is distributed over many of pad components 314, which cushion or otherwise attenuate the impact force. That is, the rigid or semi-rigid polymer material forming plate element 315 distributes impact forces, and the compressible polymer foam materials of pads 313 impart cushioning or otherwise attenuate the impact forces. When incorporated into apparel system 100 cover components 210 from outer garment 200 impart further attenuation of the impact forces and may assist with protecting other individuals.

In addition to distributing and attenuating impact forces, protective component 305 has an advantage of simultaneously providing one or more of breathability, a relatively low overall mass, and launderability. When used for athletic activities, individual 10 may perspire and generate excess heat. By utilizing a permeable textile for material layers 311 and 312 and also forming gaps between adjacent pads 313 and areas between pads 313 and frame 314, areas for air to enter the apparel and for moisture to exit the apparel are formed through cushioning element 310. More particularly, air and moisture may pass through material layers 311 and 312, between pads 313 in areas where frame 314 is absent, and between pads 313 and frame 314 in areas where frame 314 is present to impart breathability to areas of the apparel having cushioning element 310. Moreover, the materials and structure discussed above for cushioning element 310 impart a low overall mass to cushioning element 310. Furthermore, the materials and structure discussed above for cushioning element 310 permits cushioning element 310 to be laundered without significant shrinkage or warping, even when temperatures associated with commercial laundering processes are utilized. Accordingly, cushioning element 310 may simultaneously provide impact force distribution, impact force attenuation, breathability, a relatively low overall mass, and launderability to apparel system 100.

The combination of garments 200 and 300 effectively form a layered structure that includes material layers 211, 212, 311, and 312; pads 213 and 313; frame 314; and plate element 315. The layered structure has a configuration wherein plate elements 315 are located between polymer foam materials. More particularly, plate elements 315 are located between each of pads 213 and 313, as well as frame 314. As discussed above, cover components 210 may overlap, extend over, or otherwise coincide with the positions of some cushioning elements 310 of inner garment 300, and cover components 210 may be utilized to provide protection to other athletes or individuals from the relatively hard or rigid materials of cushioning elements 310. In apparel system 100, cover components 210 overlap only the cushioning elements 310 that incorporate plate elements 315. Given that plate elements 315 from relatively hard or rigid materials, cover components 210 may be utilized to provide protection to other athletes or individuals from plate elements 315. Moreover, pads 213 may have a greater area than plate elements 315 such that pads 213 completely cover plate elements 315. Even if components 210 and 305 move relative to each other, the larger pads 213 may remain in an overlapping configuration with plate elements 315 to continue providing protection to other athletes or individuals from plate elements 315.

Further Configurations

Aspects of protective components 305 may vary, depending upon the intended use for protective components 305, the types of apparel that protective components 305 are used in, and their locations within apparel, for example. Moreover, changes to the dimensions, shapes, and materials utilized within protective components 305 may vary the overall properties of protective components 305. That is, by changing the dimensions, shapes, and materials utilized within protective components 305, the compressibility, impact force attenuation and distribution, breathability, flexibility, and overall mass of protective components 305 may be tailored to specific purposes or types of apparel. A plurality of variations for protective components 305 are discussed below. Any of these variations, as well as combinations of these variations, may be utilized to tailor the properties of protective components 305 to an intended use or particular product. Moreover, any of the various configurations disclosed in U.S. Provisional Patent Application Ser. No. 61/158,653, which was previously entirely incorporated herein by reference, may be utilized for cushioning element 310.

Figure 18A:
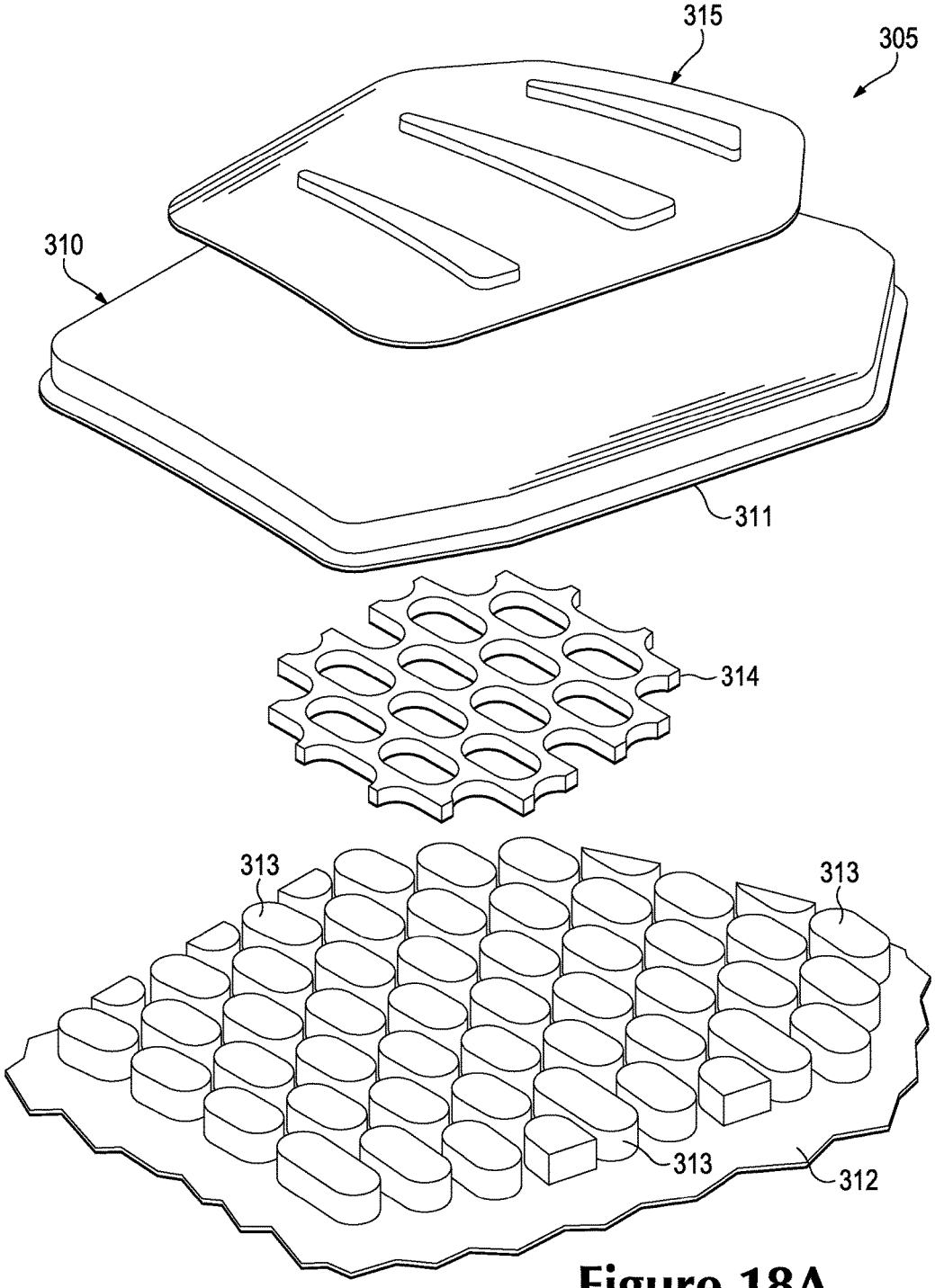
FIGS. 18A-18G are exploded perspective views corresponding with FIG. 14 and depicting further configurations of the protective component.
Figure 18B:
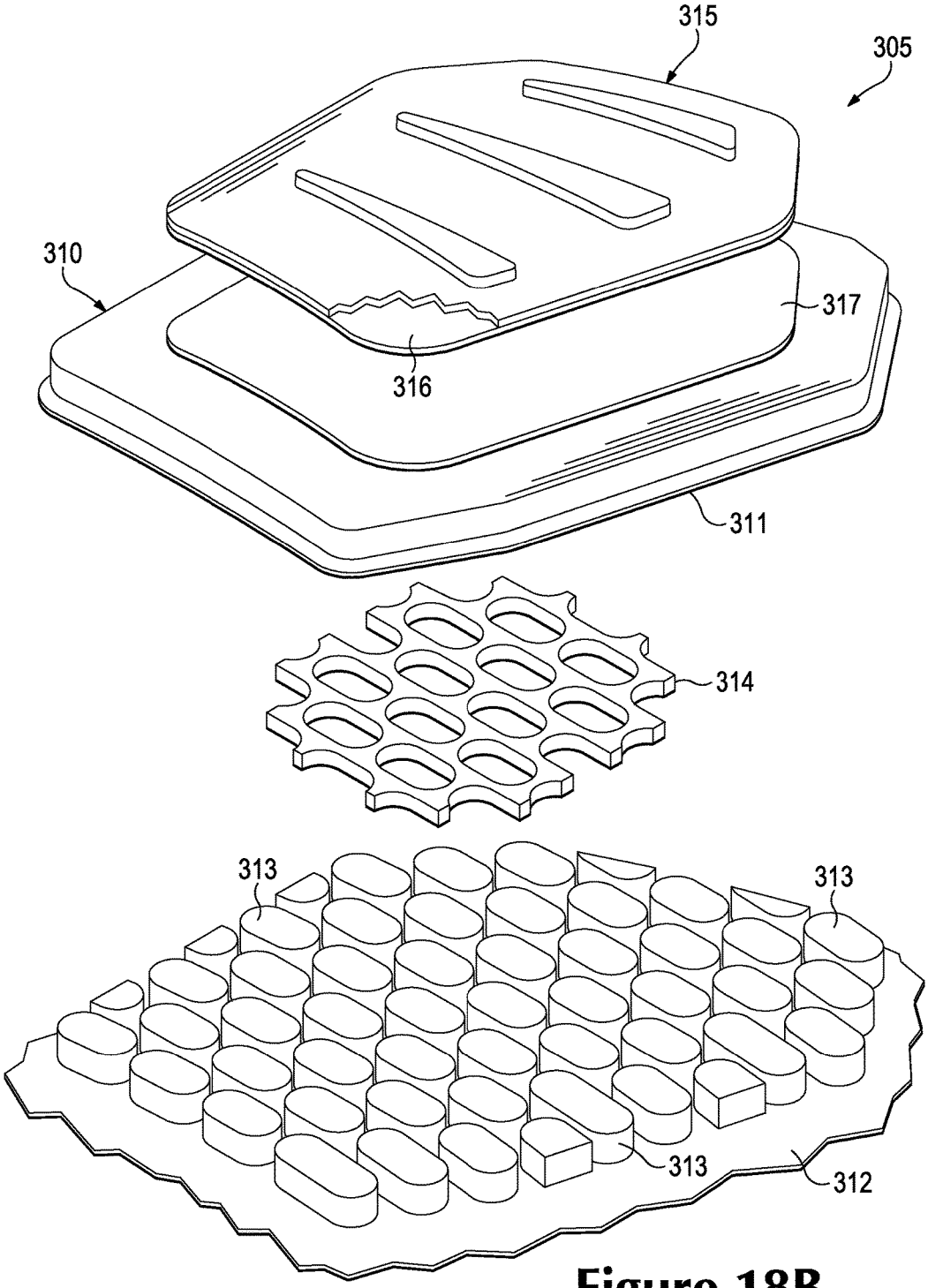
Figure 18C:
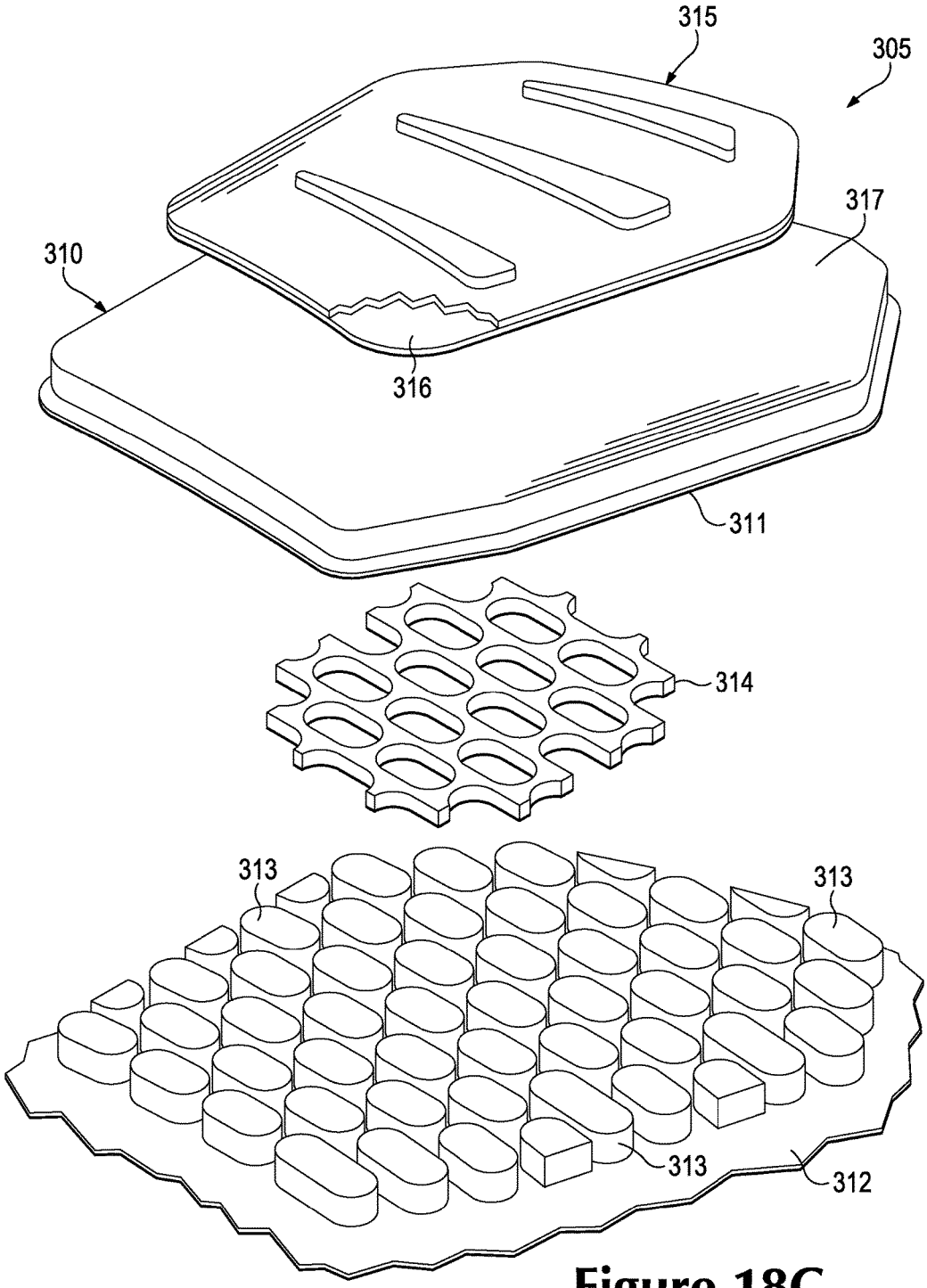

A further configuration of protective components 305 is depicted in FIG. 18A, wherein securing elements 326 are absent. In this configuration, each of pads 313 have similar shapes and do not define apertures (i.e., apertures 324) for receiving securing elements 326. In order to secure plate element 315, adhesive bonding, thermal bonding, or stitching may be utilized. In other configurations, a hook-and-loop fastener system may be utilized to join plate element 315 to cushioning element 310. Referring to FIG. 18B, for example, a first part 316 of a hook-and-loop fastener system is secured to an underside of plate element 315 and a second part 317 of the hook-and-loop fastener system is secured to an exterior of first material layer 311. As another example, FIG. 18C depicts a similar configuration where first material layer 311 incorporates or is formed by second part 317 of the hook-and-loop fastener system. That is, first material layer 311 may be second part 317 of the hook-and-loop fastener system.

Figure 18D:
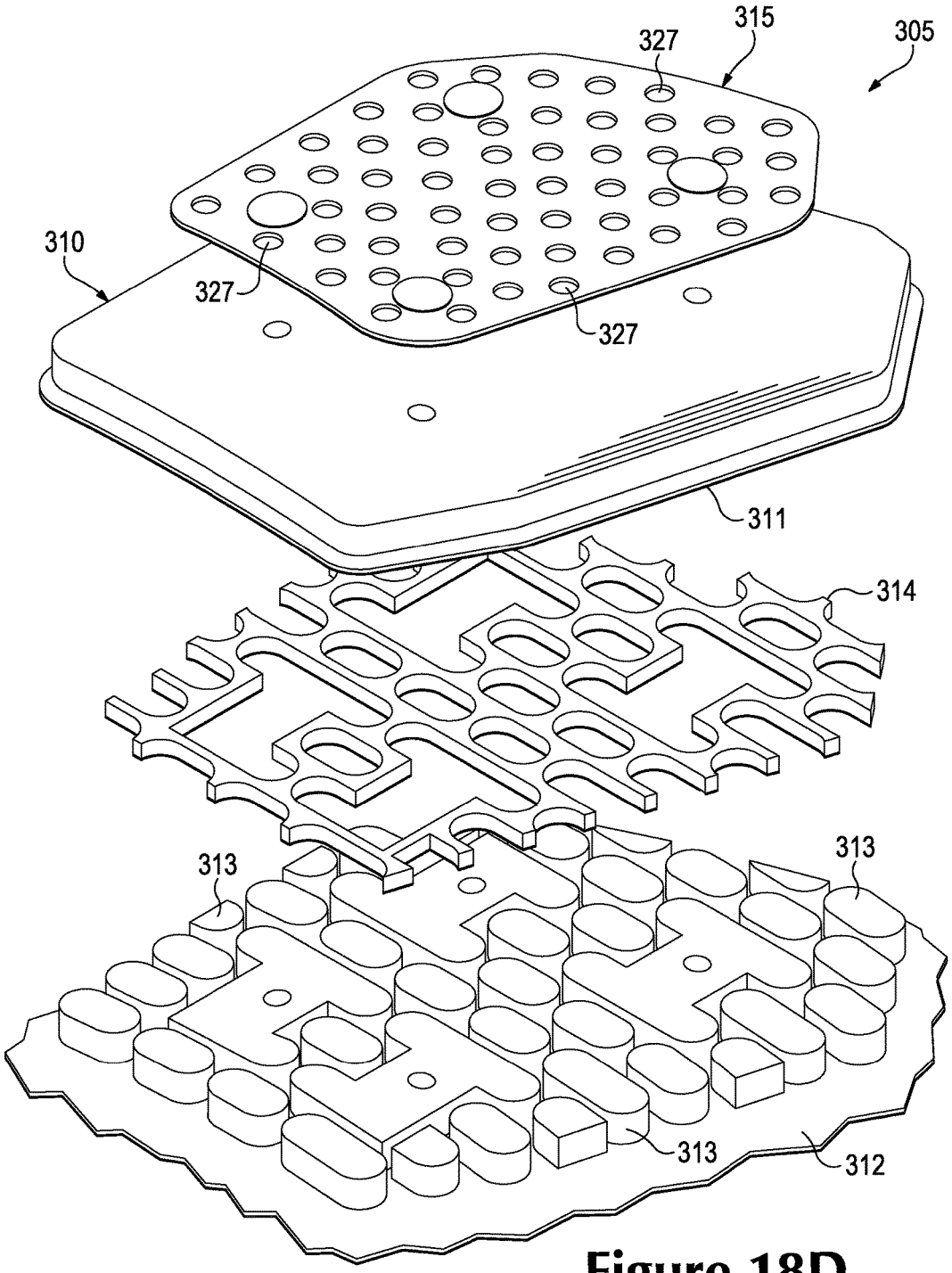
Figure 18E:
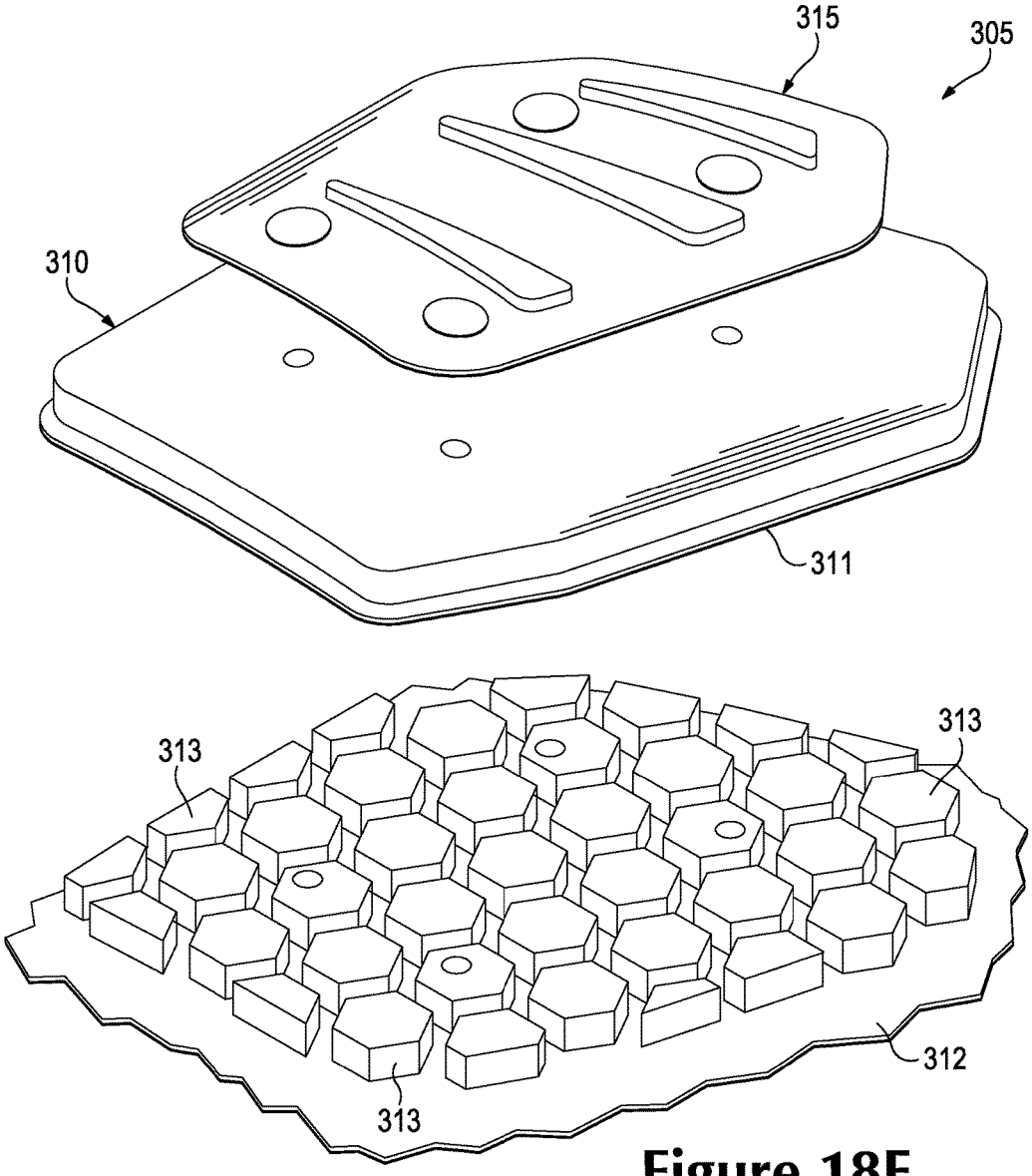
Figure 18F:
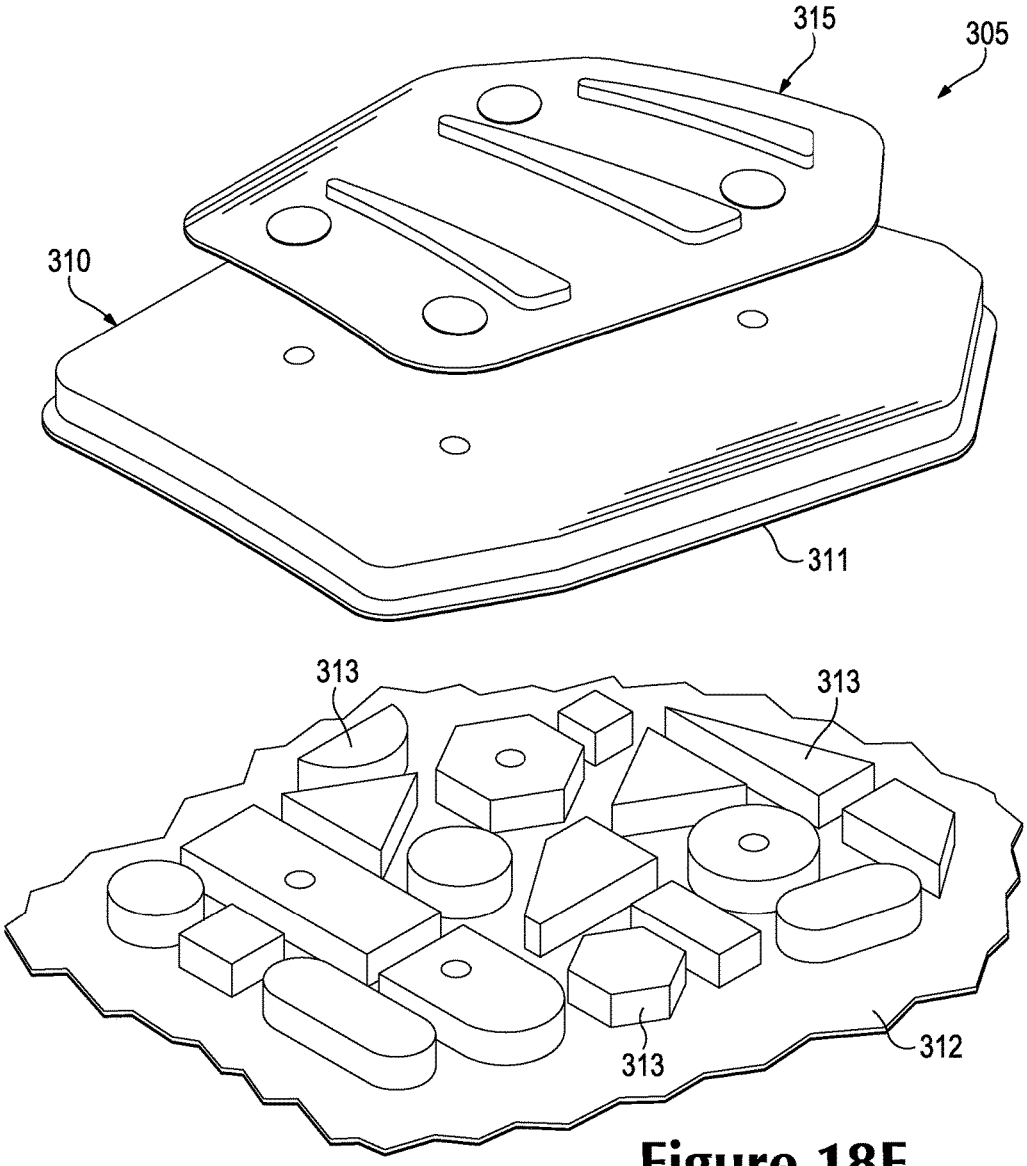
Figure 18G:
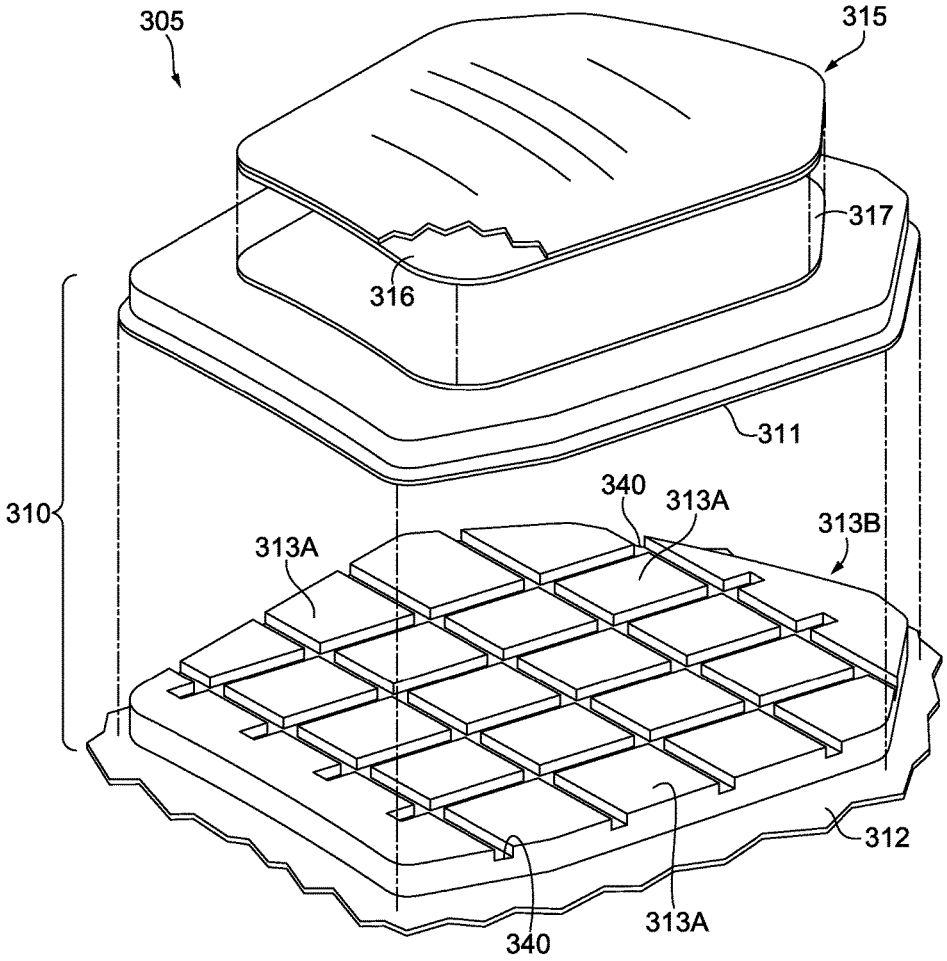

In a further example, FIG. 18G includes a first part 316 of a hook-and-loop fastener system secured to an underside of plate element 315 and a second part 317 of the hook-and-loop fastener system secured to an exterior of first material layer 311. The first part 316 of the hook-and-loop fastener system is illustratively depicted as covering an area similar in size as the plate element 315. But in other aspects, the first part 316 may cover less than the total area of the surface of the plate element 315. In addition, the second part 317 of the hook-and-loop fastener system may be a strip or sheet of second-part fasteners coupled to the first material layer 311, or the second part 317 may be incorporated into or form the first material layer 311. The pad 313B formed as a one-piece unit from a plurality of pads 313A that are connected. That is, pads 313A make up a one-piece, integrated pad 313B, in which the pads 313A are delineated by indentions 340 (e.g., elongated grooves). For example, the pad 313B includes indentions that extend only partially through a thickness of the pad 313B. Among other things, the indentions 340 may enhance pad flexibility. In a further aspect, the pad 313B may include apertures that extend entirely through a thickness of the pad 313B. Another exemplary pad 313B may not include any indentions and/or apertures. As described in other parts of this description, the first material layer 311 may include various types of materials, such as a knit, woven, non-woven, or polymer-sheet material. In addition, the second material layer 311 may include a same material as the first material layer 311 or may include a material that is different from the first material layer 311. For example, in one aspect the first material layer 311 includes a polymer-sheet material (e.g., thermoplastic polymer sheet) and the second material layer 312 includes a knit, woven, or non-woven textile. In another aspect, the first material layer 311 includes a mesh-style textile and the second material layer 312 includes a different knit, woven, or non-woven textile. The pad 313B may be constructed of various types of materials, such as a polymer composition (e.g., polymer foam). For illustrative purposes, the plate 315 is depicted as relatively planar. In another aspect, the plate 315 might include a curved profile shaped to nest with a portion of a wearer (e.g., thigh).

An advantage of utilizing the hook-and-loop fastener system is that plate element 315 may be easily separated, repositioned, or replaced with another plate having a different configuration (e.g., shape, thickness, flexibility). That is, parts 316 and 317 may be separated from each other and then rejoined following repositioning or replacement. Although parts 316 and 317 are depicted as having a size and shape of plate element 315 in FIG. 18B, either of both of parts 316 and 317 may have any shape or size that facilitates joining and separating plate element 315 from cushioning element 310. Moreover, cushioning element 310 may be used to impart cushioning and protection without plate element 315 during some activities, and then plate element 315 may be rejoined to cushioning element 310 for other activities. Accordingly, the presence of the hook-and-loop fastening system provides configurability and variability to the use of apparel system 100.

Further configurations of protective components 305 may include a variety of additional features. As depicted in FIG. 18D, ribs 328 are absent from plate element 315 and a plurality of apertures 327 extend through plate element 315. Advantages of the various apertures 327 are that the flexibility and breathability of plate element 315 may be increased. Pads 313 are discussed above as having an elliptical or generally elongate shape with rounded end areas. Pads 313 may, however, have a variety of other shapes, including hexagonal shapes, as depicted in FIG. 18E. Pads 313 may also have a variety of other shapes, such as round shapes, triangular shapes, rectangular shapes, or irregular shapes. Pads 313 may also have a mixture of different shapes, as depicted in FIG. 18F. Additionally, frame 314 may be absent from some configurations, as also depicted in FIGS. 18E and 18F.

Figure 19A:
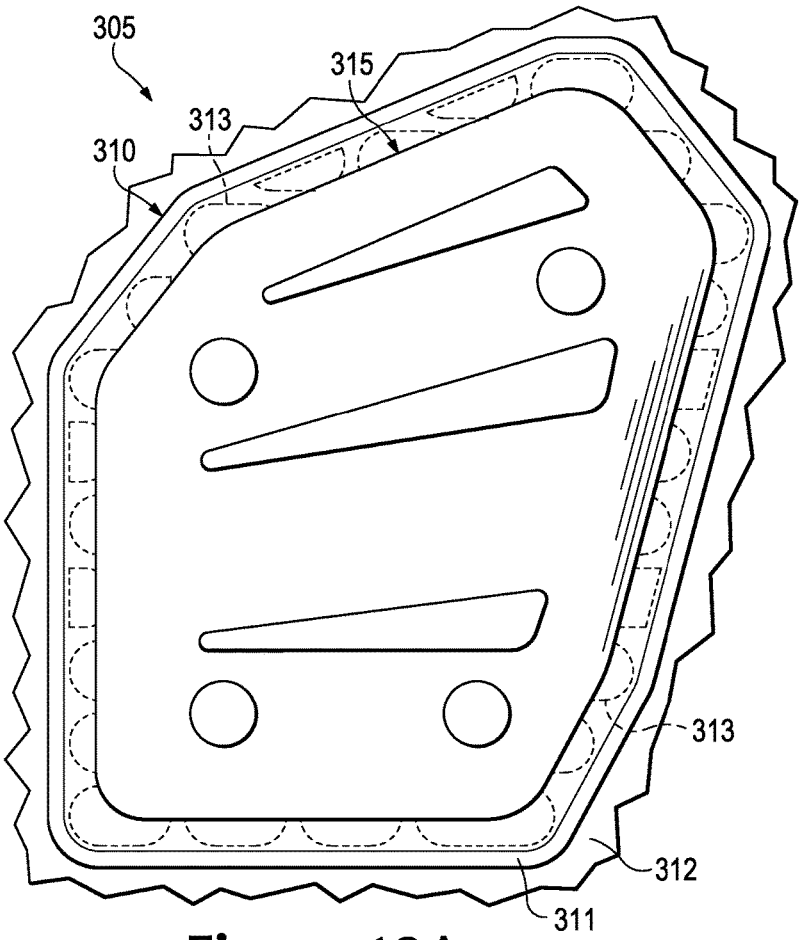
FIGS. 19A-19E are top plan views corresponding with FIG. 15 and depicting further configurations of the protective component.
Figure 19B:
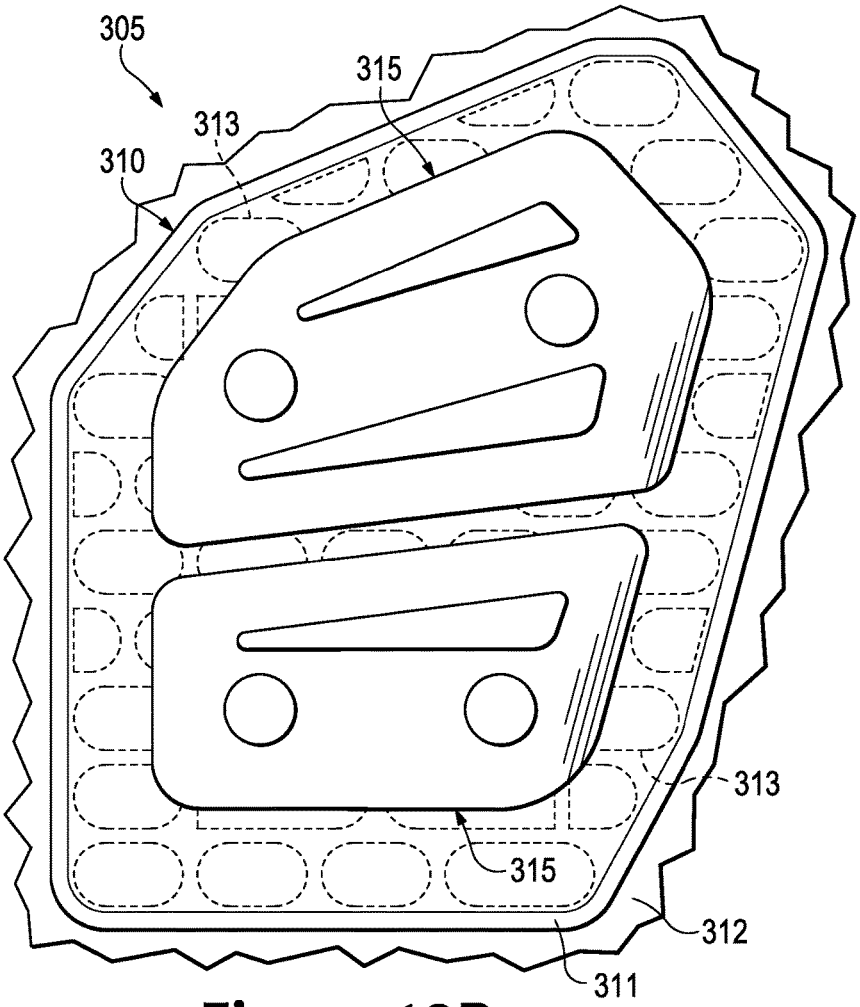
Figure 19C:
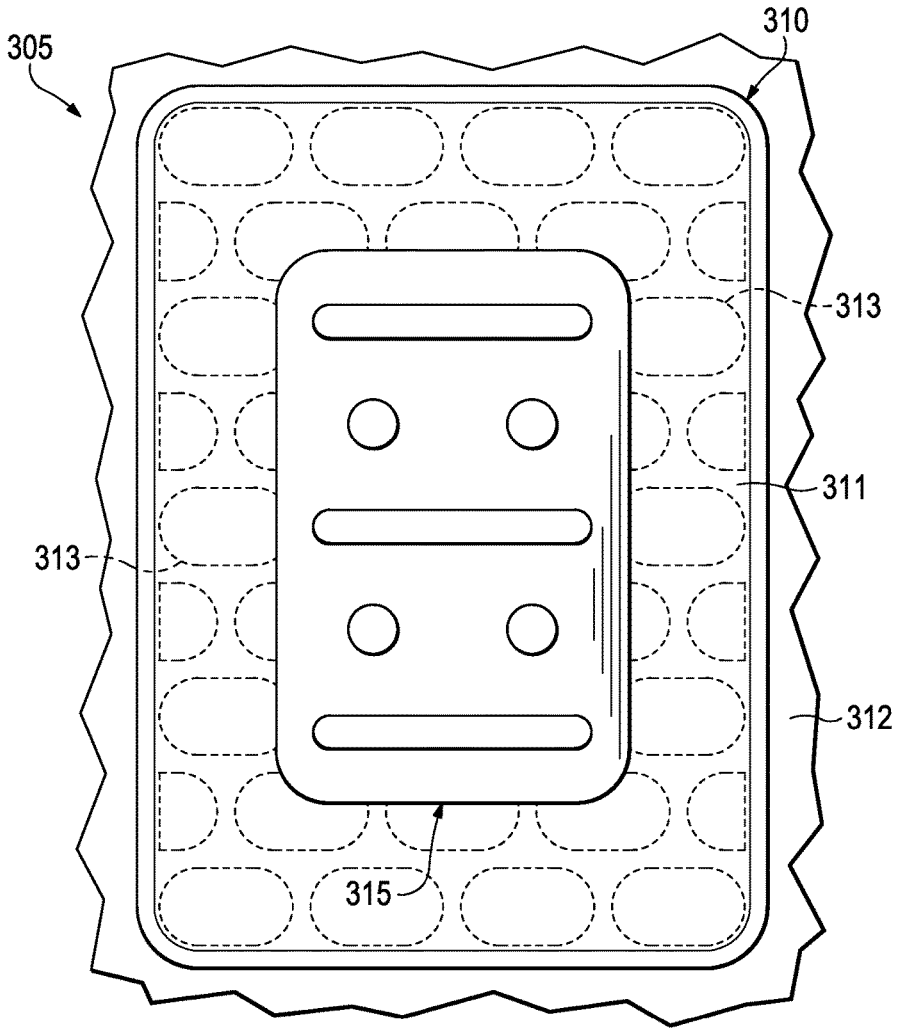
Figure 19D:
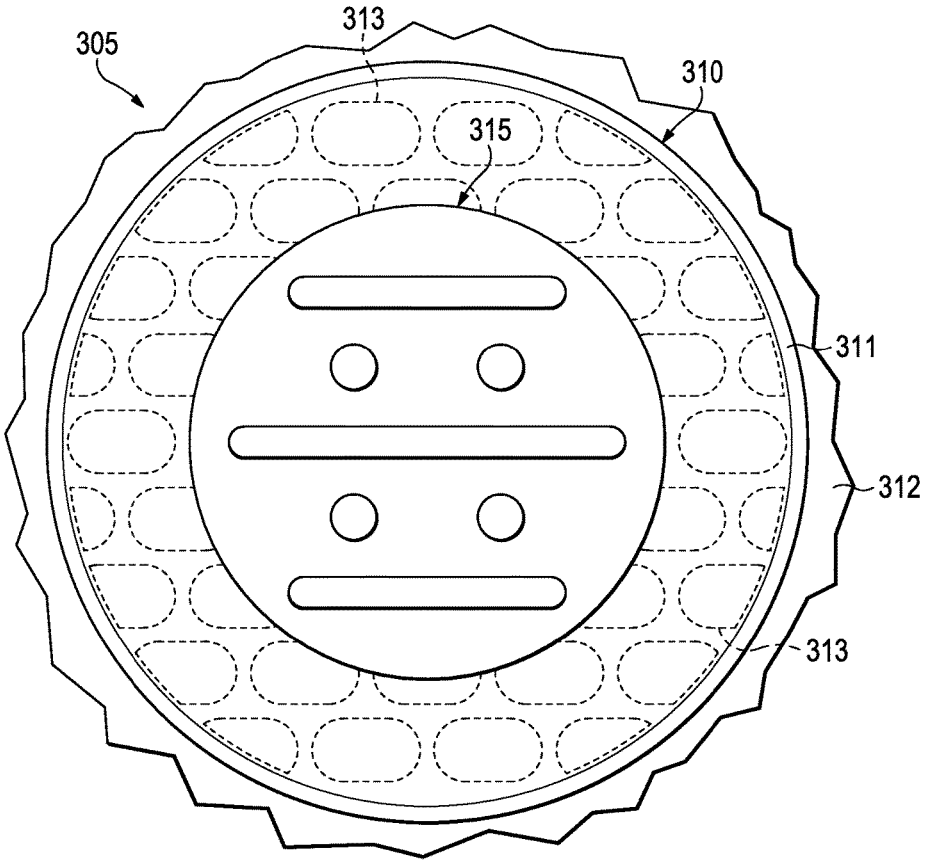
Figure 19E:
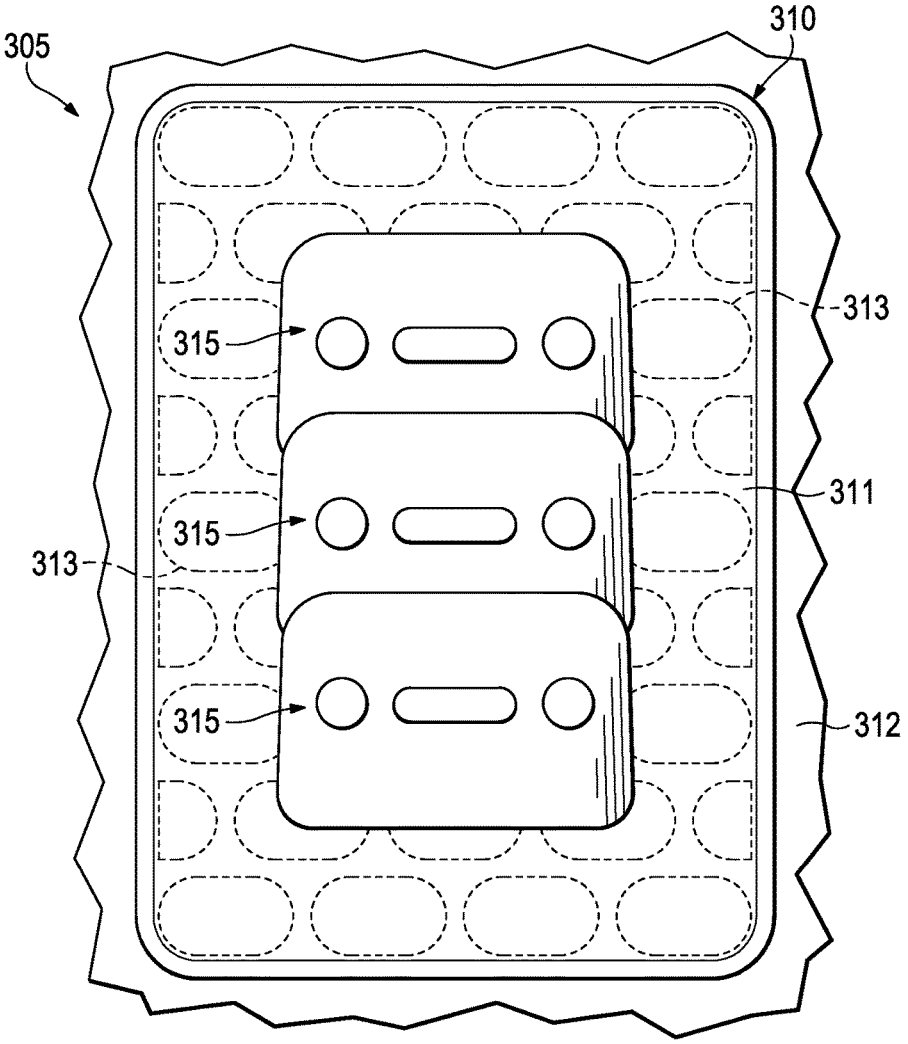

Plate element 315 may cover a majority or even all of cushioning element 310, as depicted in FIG. 19A. In further configurations, two or more plate elements 315 may be utilized, as depicted in FIG. 19B. In addition to changes in the shape of plate element 315, the overall shape of protective components 305 may vary significantly, as depicted by the rectangular and circular shapes in FIGS. 19C and 19D. As noted above with the configuration of FIG. 19A, two or more plate elements 315 may be utilized. Referring to FIG. 19E, a similar configuration wherein three separate plate elements 315 overlap each other is depicted to impart flexibility without gaps or other discontinuities between plate elements 315.

Figure 20A:
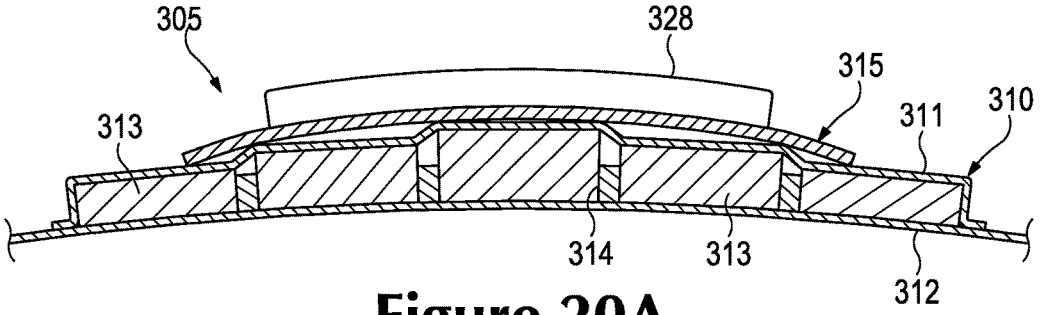
FIGS. 20A-20C are cross-sectional views corresponding with FIG. 16A and depicting further configurations of the protective component.
Figure 20B:
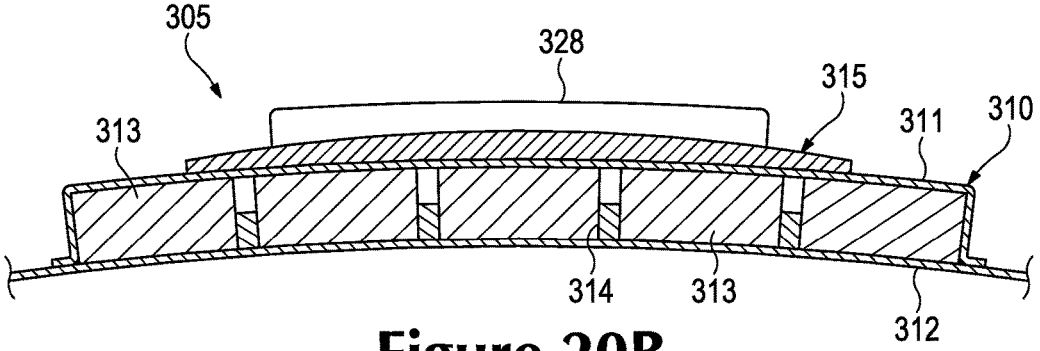
Figure 20C:
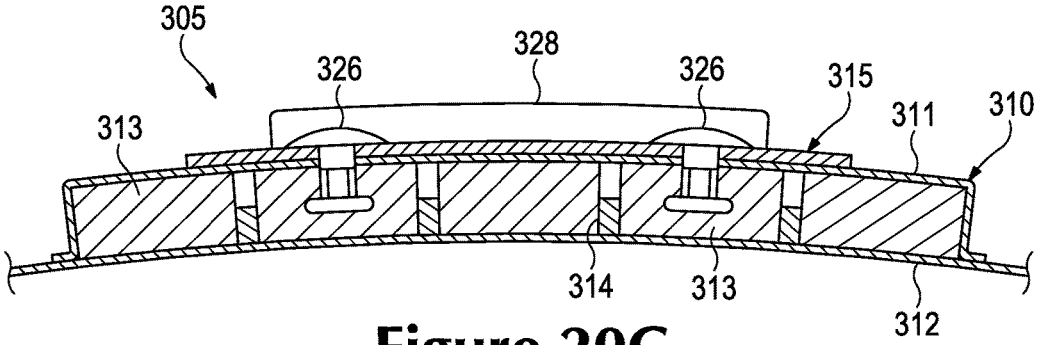

Although the thicknesses of pads 313 may be substantially identical, the thicknesses may also vary, as depicted in FIG. 20A. The thickness of plate element 315 may also vary. As depicted in FIG. 20B, the thickness of plate element 315 tapers across the width of cushioning element 310. In some configurations of cushioning element 310, securing elements 326 may also be anchored within pads 313, rather than extending through pads 313.

Article of Protective Apparel

Figure 21:
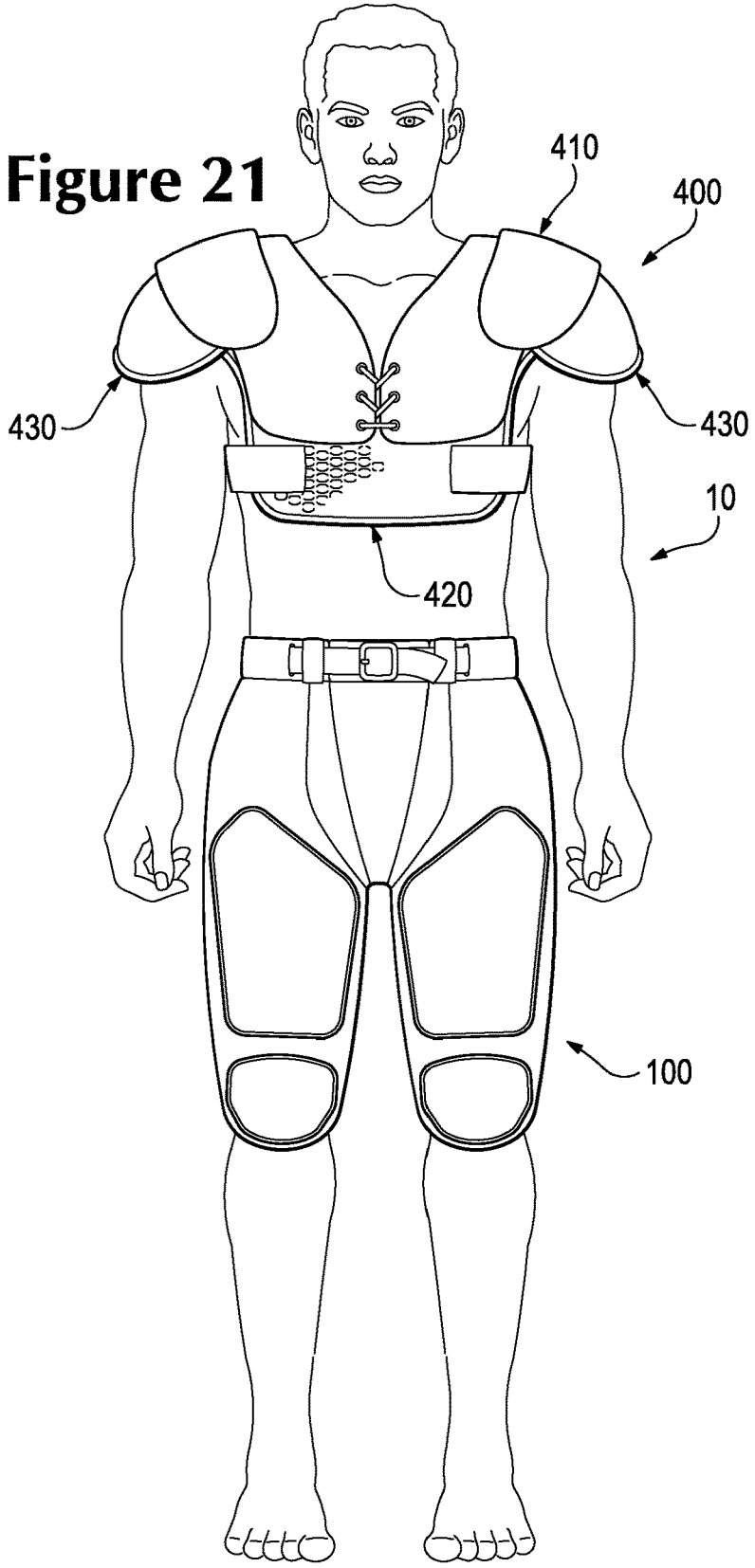
FIG. 21 is a front elevational view of the individual wearing an article of protective apparel having a configuration of shoulder pads and including a plate element and a cushioning element.

With reference to FIG. 21, individual 10 is depicted as wearing an article of protective apparel 400 with the configuration of shoulder pads, which may be utilized in various contact sports, such as American football. Protective apparel 400 includes a plate element 410, a torso cushioning element 420, and a pair of shoulder cushioning elements 430. Plate element 410 covers or extends over an upper torso and shoulders of individual 10. Torso cushioning element 420 is secured to plate element 410 and located between plate element 410 and individual 10. Moreover, torso cushioning element 420 covers or extends over the upper torso and a middle torso of individual 10, thereby extending downward from plate element 410. Shoulder cushioning elements 430, which cover or extend over the shoulders, are also secured to plate element 410 and located between plate element 410 and individual 10. In combination, elements 410, 420, and 430 impart padding, cushioning, or otherwise attenuate impact forces, thereby imparting protection to individual 10.

Figure 22:
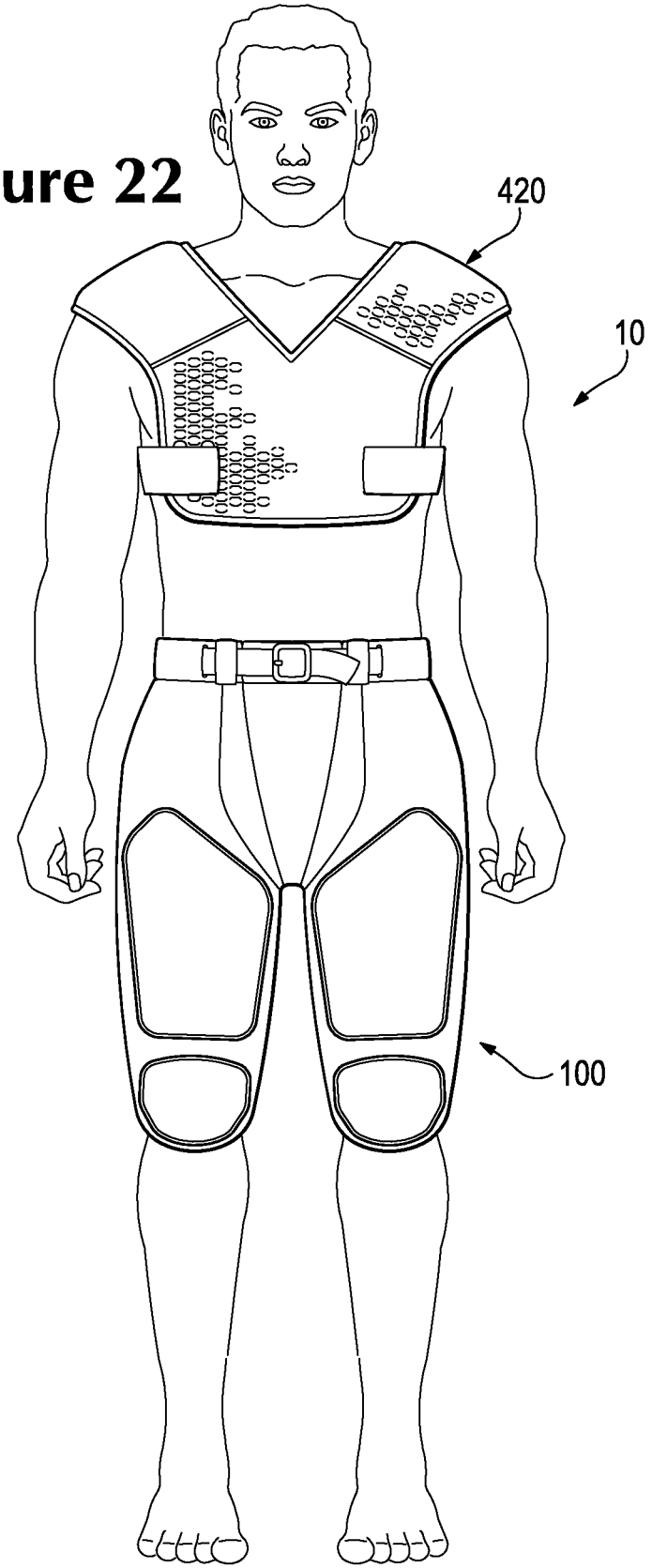
FIG. 22 is a front elevational view of the individual wearing the cushioning element.

In the sport of American football, for example, shoulder pads are worn by athletes during athletic competitions. For some athletic training sessions (e.g., practices), however, separate protective pads that do not include plate-like components are worn in place of the shoulder pads. Accordingly, athletic organizations, schools, teams, or the athletes generally purchase or otherwise obtain both the shoulder pads and the protective pads for each of the athletes. An advantage of protective apparel 400, however, relates to the separability of elements 410 and 420. During the athletic competitions, the combination of plate element 410, torso cushioning element 420, and shoulder cushioning elements 430 may be worn to impart protection to individual 10 from contact with other athletes, equipment, or the ground. During the athletic training sessions, however, torso cushioning element 420 may be separated from plate element 410, and torso cushioning element 420 may be worn alone, as depicted in FIG. 22, to provide a moderate degree of protection to individual 10 from contact with other athletes, equipment, or the ground. That is, torso cushioning element 420 may be worn without plate element 410 during the athletic training sessions. Prior to an athletic competition, elements 410 and 420 may be rejoined for use during the athletic competition. As such, athletic organizations, schools, teams, or the athletes may obtain protective apparel 400 to be properly outfitted during both the athletic competitions and the athletic training sessions.

Figure 23:
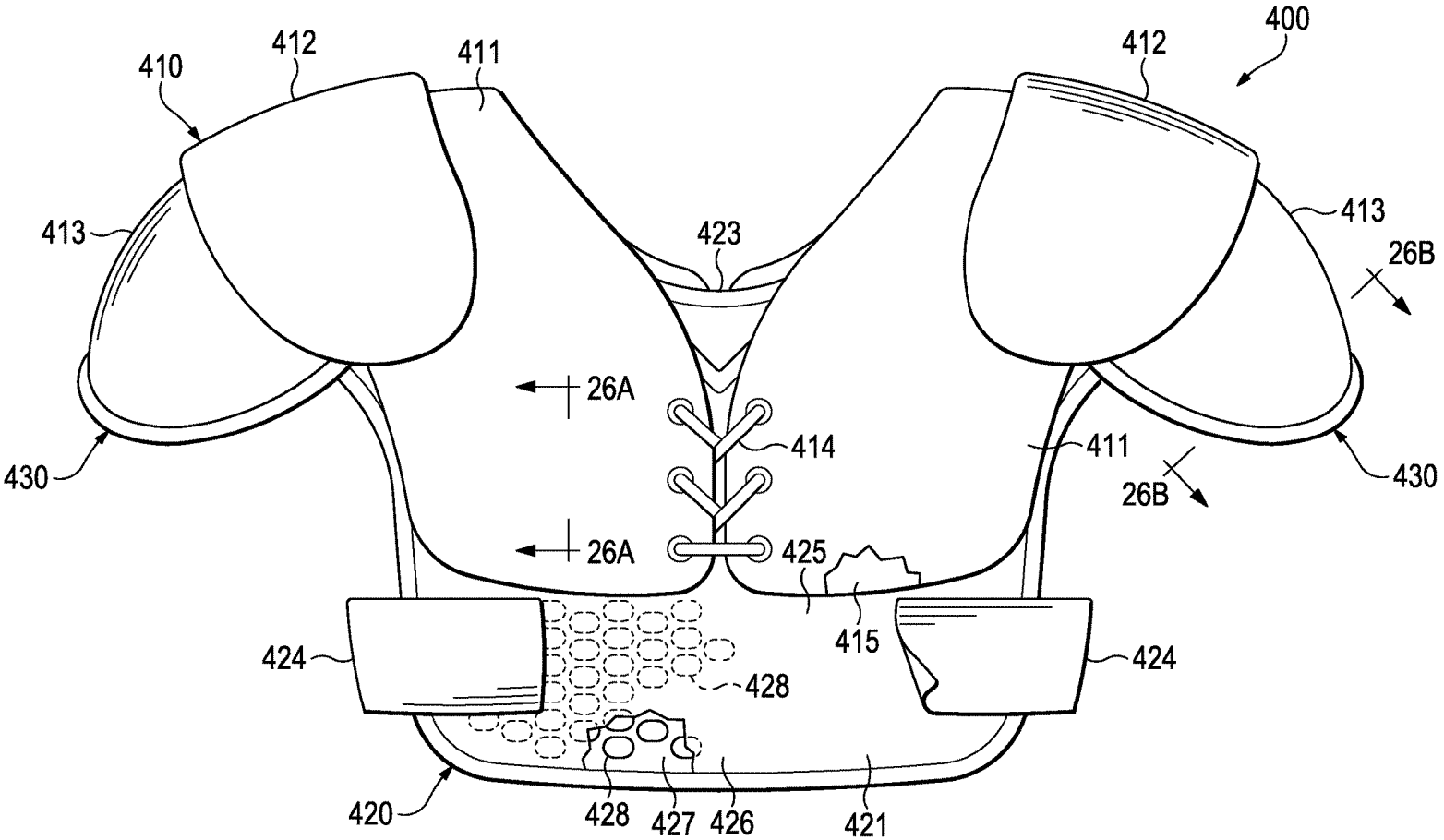
FIG. 23 is a front elevational view of the article of protective apparel.
Figure 24:
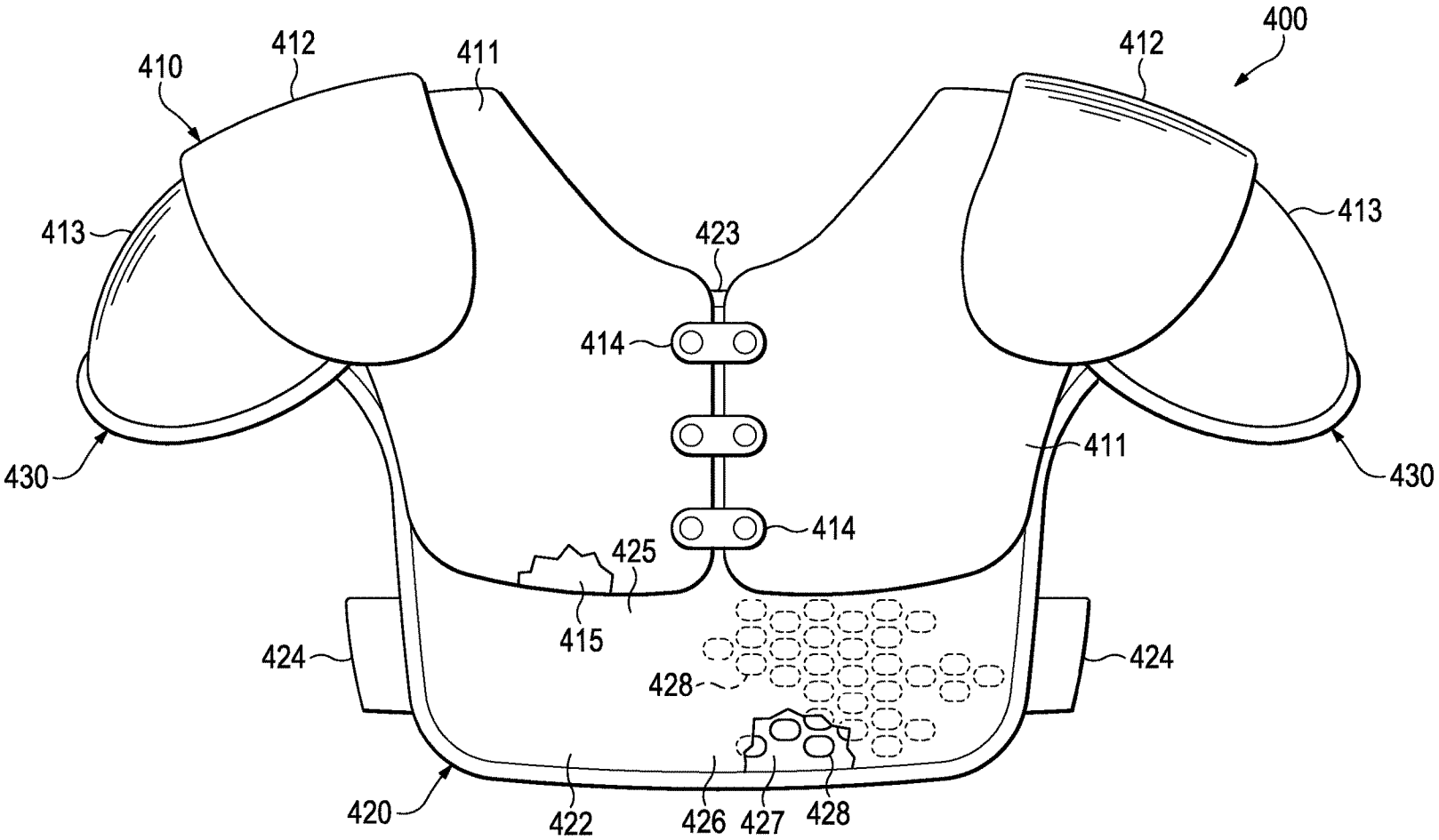
FIG. 24 is a rear elevational view of the article of protective apparel.
Figure 25:
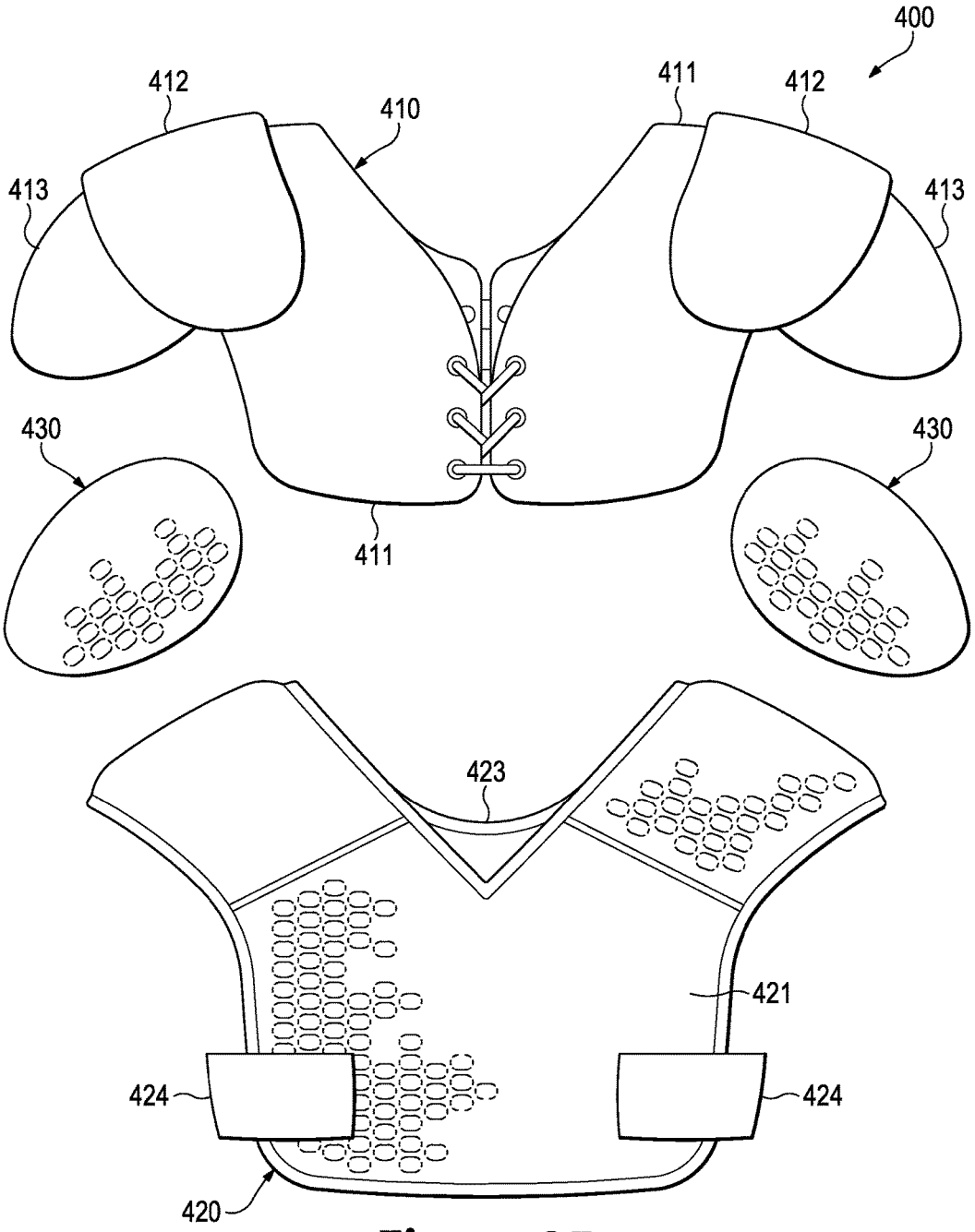
FIG. 25 is an exploded front elevational view of the article of protective apparel.

Protective apparel 400 is depicted individually in FIGS. 23-25. Plate element 410 includes a torso portion 411, two inner shoulder portions 412, and two outer shoulder portions 413. Torso portion 411 covers or otherwise extends over an upper torso of individual 10. More particularly, torso portion 411 extends over both the chest and back of individual 10. Torso portion 411 may be formed from a plurality of plate-like components that are joined by various connectors 414. For example, one of connectors 414 on a front side of plate element 410 has a configuration of a lace that extends repeatedly between two plate-like components, thereby providing some adjustability. Various connectors 414 on a back side of plate element 410 have configurations of straps that extend between two plate-like components.

Shoulder portions 412 and 413 also have the configuration of plate-like components and cover or otherwise extend over the shoulders of individual 10. Inner shoulder portions 412 overlap spaces between torso portion 411 and outer shoulder portions 413. In some configurations, each of shoulder portions 412 and 413 are flexibly-secured to torso portion 411. In other configurations, outer shoulder portions 413 are flexibly-secured to inner shoulder portions 412, and inner shoulder portions 412 are flexibly-secured to torso portion 411. In either configuration, shoulder portions 412 and 413 are secured at opposite sides of torso portion 411.

Plate element 410 is primarily formed from a semi-rigid or rigid polymer material, which may be a non-foamed polymer material. Examples of suitable polymer materials for plate element 410 (i.e., portions 411, 412, and 413) include polyethylene, polypropylene, acrylonitrile butadiene styrene, polyester, thermoset urethane, thermoplastic urethane, polyether block amide, polybutylene terephthalate various nylon formulations, or blends of these materials. Composite materials may also be formed by incorporating glass fibers, aramid fibers, or carbon fibers, for example, into the polymer materials discussed above in order to enhance the strength and rigidity of plate element 410. In some configurations, plate element 410 may also be formed from metal materials (e.g., aluminum, titanium, steel) or may include metal elements that enhance the strength and rigidity of plate element 410. Accordingly, a variety of materials may be utilized for plate element 410.

Figure 27:
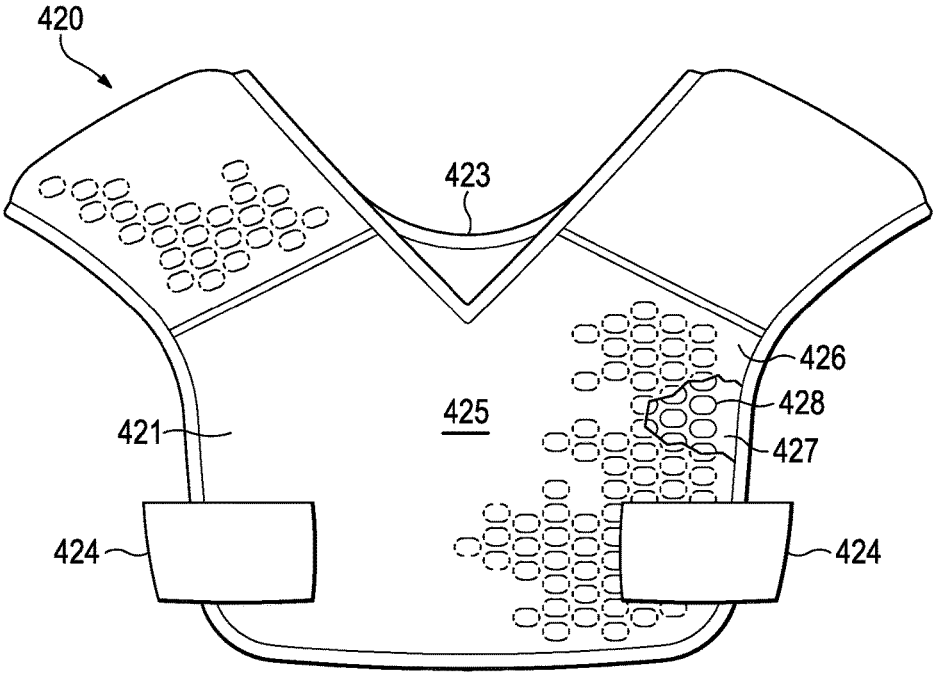
FIG. 27 is a front elevational view of the cushioning element.
Figure 28:
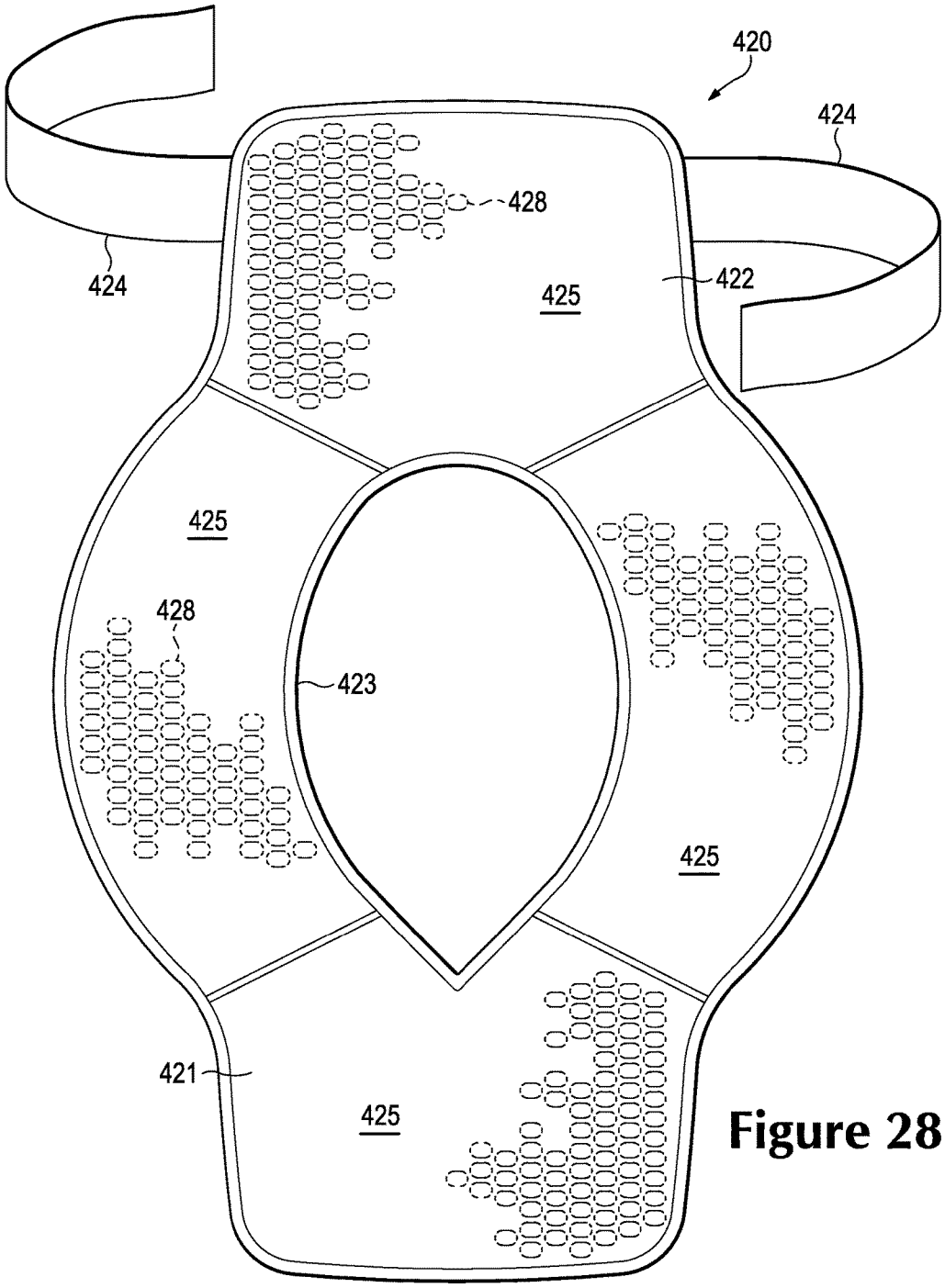
FIG. 28 is a plan view of the cushioning element in a flat configuration.

Torso cushioning element 420 is depicted in combination with plate element 410 in FIGS. 23-25 and is depicted individually in FIGS. 27 and 28. When secured to plate element 410, torso cushioning element 420 is located between plate element 410 and individual 10 to cover or extend over the upper torso and middle torso of individual 10. Although torso cushioning element 420 may have a variety of configurations, torso cushioning element 420 is depicted as including (a) a chest portion 421 that covers or extends over a chest of individual 10, (b) a back portion 422 that covers or extends over a back of individual 10, and (c) a neck aperture 423 located between portions 421 and 422 for receiving or extending around a neck of individual 10. As such, torso cushioning element 420 covers many of the same areas of individual 10 as plate element 410. In order to impart additional protection, however, torso cushioning element 420 extends downward to cover the middle torso. At the middle torso, therefore, torso cushioning element 420 forms the exterior surface of protective apparel 400. In order to secure torso cushioning element 420 to individual 10, two straps 424 extend between lower areas of portions 421 and 422.

Figure 26A:
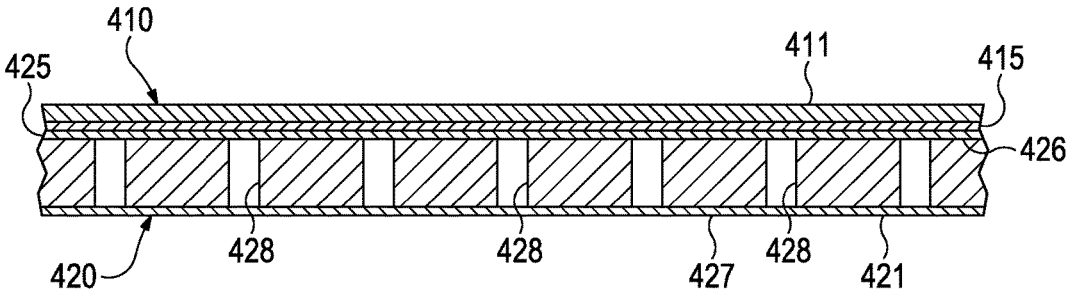
FIGS. 26A and 26B are cross-sectional views of the article of protective apparel, as defined by section lines 26A and 26B in FIG. 23.

The primary elements of torso cushioning element 420 are a first material layer 426, a second material layer 427, and a plurality of compressible pads 428 located between and secured to material layers 426 and 427, as depicted in FIG. 26A. In general, torso cushioning element 420 has the configuration of cushioning element 310. As such, first material layer 426 and second material layer 427 cooperatively form a pocket or void, in which pads 428 are located, and opposite surfaces of pads 428 are secured to material layers 426 and 427. Although pads 428 are spaced evenly from each other and arranged in offset rows, other configurations for pads 428 may be utilized. Moreover, pads 428 are generally discrete elements that are spaced from each other, but may also be connected or formed as a one-piece unit. Given this configuration, torso cushioning element 420 may simultaneously provide one or more of breathability, a relatively low overall mass, and launderability.

A variety of materials may be utilized for pads 428, including any of the various materials discussed above for pad 213, such as polymer foam materials and fluid-filled chambers. As a comparison with the compressible polymer foam material forming pads 428, plate element 410 is discussed above as including a semi-rigid or rigid polymer material. As such plate element 410 may have greater stiffness and density than the polymer foam material of pads 428. As another comparison, whereas pads 428 may be formed from a polymer foam material, plate element 410 may include a non-foamed polymer material.

A hook-and-loop fastening system may be used to join plate element 410 and torso cushioning element 420. More particularly, plate element 410 may include a first part 415 of the hook-and-loop fastening system, and torso cushioning element 420 may incorporate a second part 425 of the hook-and-loop fastening system. Moreover, first part 415 is joinable to second part 425 to secure plate element 410 to torso cushioning element 420. Referring to FIGS. 23, 24, and 26A, first part 415 may be located on an inner surface of torso portion 411. Additionally, second part 425 may be incorporated into or otherwise form first material layer 426 of torso cushioning element 420. As such, first material layer 426 may be second part 425 of the hook-and-loop fastening system.

As discussed above, an advantage of protective apparel 400 relates to the separability of plate element 410 and torso cushioning element 420. The hook-and-loop fastening system readily permits elements 410 and 420 to be separated and rejoined. As such, elements 410 and 420 may be joined for use during athletic competitions, and elements 410 and 420 may be separated so that torso cushioning element 420 may be used alone during athletic training sessions. Accordingly, the hook-and-loop fastening system facilitates the use of protective apparel 400 during various types of athletic activities.

Figure 26B:
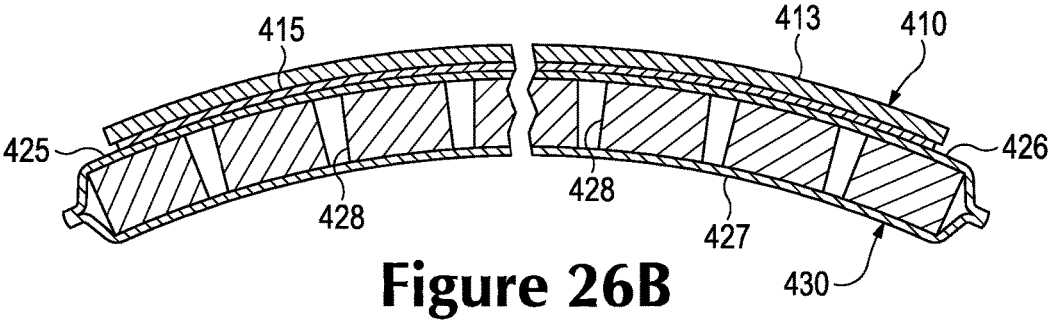

The pair of shoulder cushioning elements 430, which are depicted in FIGS. 25 and 26B, join with outer shoulder portions 413 and cover or otherwise extend over the shoulders of individual 10. As with torso cushioning element 420, shoulder cushioning elements 430 include first material layer 426, second material layer 427, and pads 428, which are located between and secured to material layers 426 and 427. Moreover, first material layer 426 forms second part 425 of the hook-and-loop fastening system, which joins with and separates from first part 415 on an underside of outer shoulder portions 413. In other configurations, additional shoulder cushioning elements 430 may be utilized with inner shoulder portions 410, or shoulder cushioning elements 430 may be lengthened or otherwise enlarged to extend under both of shoulder portions 412 and 413 on each side of protective apparel 400.

Figure 29:
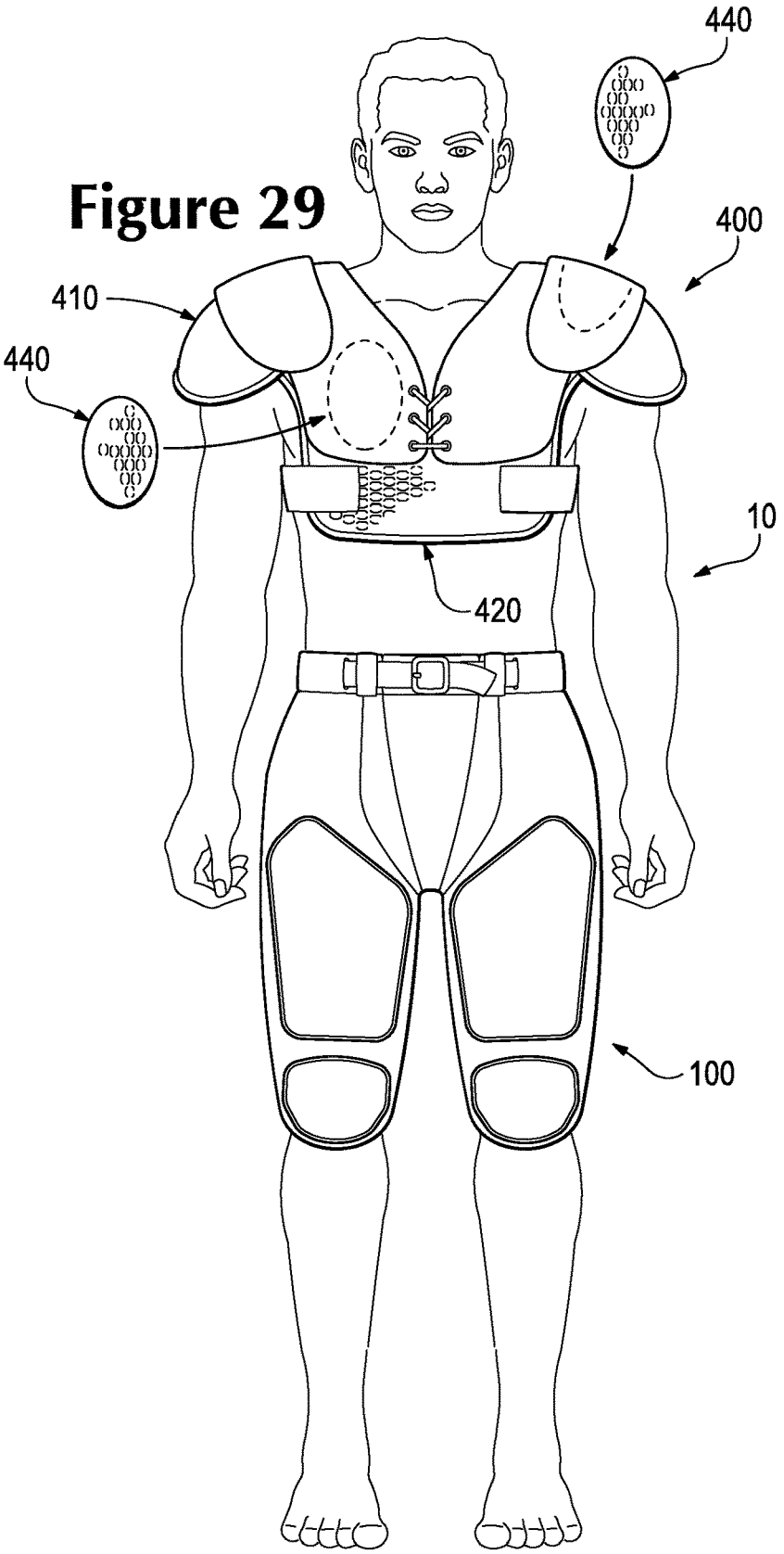
FIG. 29 is a front elevational view of the individual wearing another configuration of the article of protective apparel.

A further advantage to the protective apparel 400 is that individual 10 or another athlete may incorporate various supplemental cushioning elements 440 into areas where additional padding, cushioning, or the distribution or attenuation of impact forces padding is desired. Referring to FIG. 29, two supplemental cushioning elements 440 are depicted and may be located, as an example, under torso portion 411 and under one of inner shoulder portions 412. More particularly, supplemental cushioning elements 440 may be located between elements 410 and 420 in these areas. In some configurations, supplemental cushioning elements 440 may incorporate both parts 415 and 425 of the hook-and-loop fastening system to join with (a) first part 415 of plate element 410 and (b) second part 425 of torso cushioning element 420. As noted, supplemental cushioning elements 440 may be positioned in areas where additional impact force attenuation is desired. As examples, supplemental cushioning elements 440 may be located in areas that are prone to soreness or injury and areas of a prior injury. As such, protective apparel 410 accommodates the use of additional padding in any area, thereby providing individual 10 with the freedom to customize the force attenuation properties of protective apparel 400.

Figure 30:
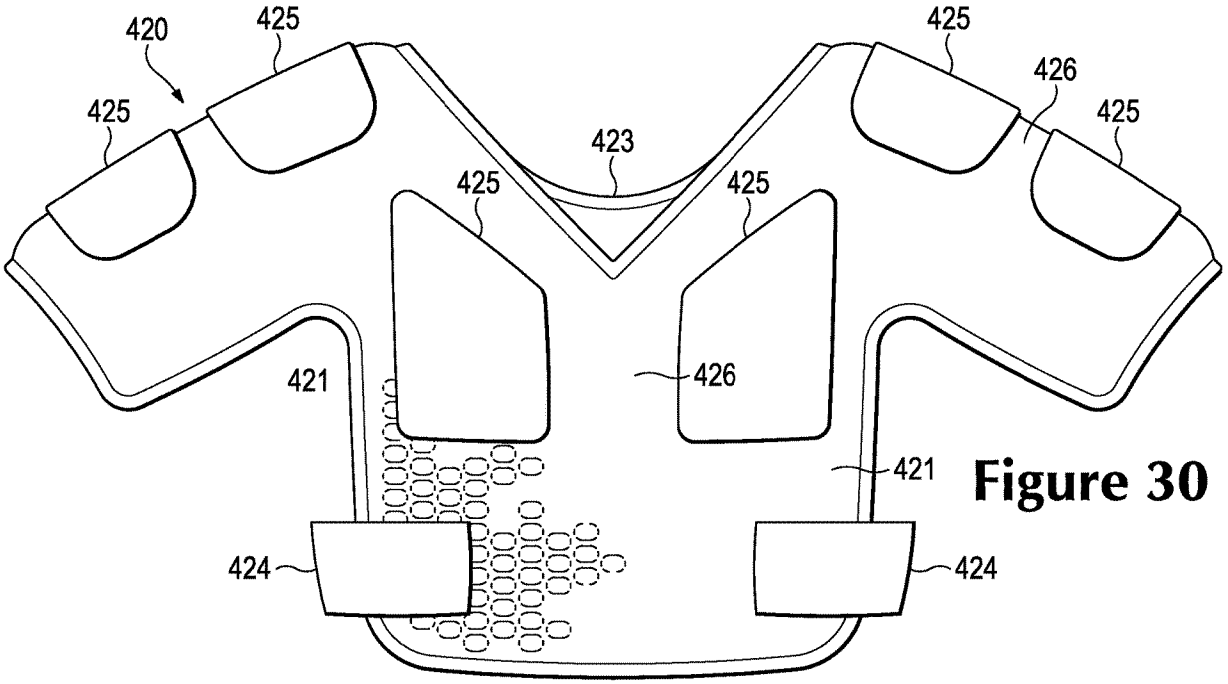
FIG. 30 is a front elevational view of another configuration of the cushioning element.

Torso cushioning element 420 is depicted as primarily covering the upper and middle torso of individual 10. In further configurations, torso cushioning element 420 may extend over other areas of individual 10. As an example, FIG. 30 depicts a configuration wherein torso cushioning element 420 would extend over the shoulders of individual 10, thereby replacing shoulder cushioning elements 430. In some configurations, shoulder cushioning elements 430 may continue to be utilized in order to impart additional cushioning to the shoulders. In other configurations, torso cushioning element 420 may extend downward to cover the lower torso and pelvic region, or torso cushioning element 420 may extend upward to protect the neck. Additional plate-like components may also extend into any of these areas to impart further protection, and the hook-and-loop cushioning system may be utilized to secure the additional plate-like components to torso cushioning element 420.

Figure 31:
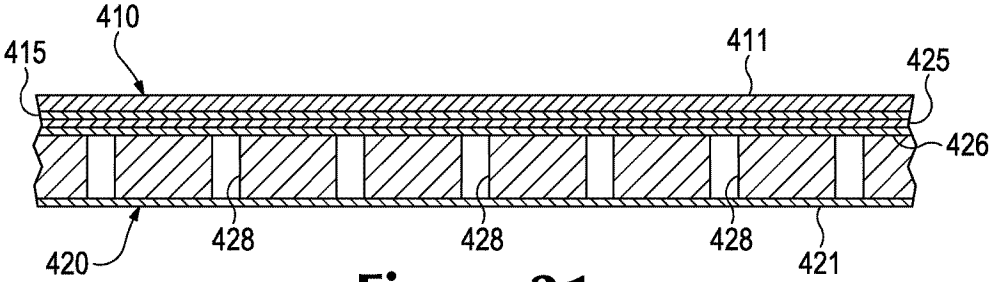
FIG. 31 is a cross-sectional view corresponding with FIG. 26A and depicting the article of protective apparel as incorporating the cushioning element from FIG. 30.

Referring again to FIG. 30, torso cushioning element 420 is depicted as including various separate components that form second part 425 of the hook-and-loop fastening system. As discussed above, first material layer 426 may be second part 425 of the hook-and-loop fastening system. In this configuration, however, the separate components of second part 425 are secured to first material layer 426 (e.g., with stitching, adhesives, thermobonding). As such, the cross-sectional configuration may appear as depicted in FIG. 31, wherein second part 425 is located between first part 415 and first material layer 426 when elements 410 and 420 are joined.

Figure 32:
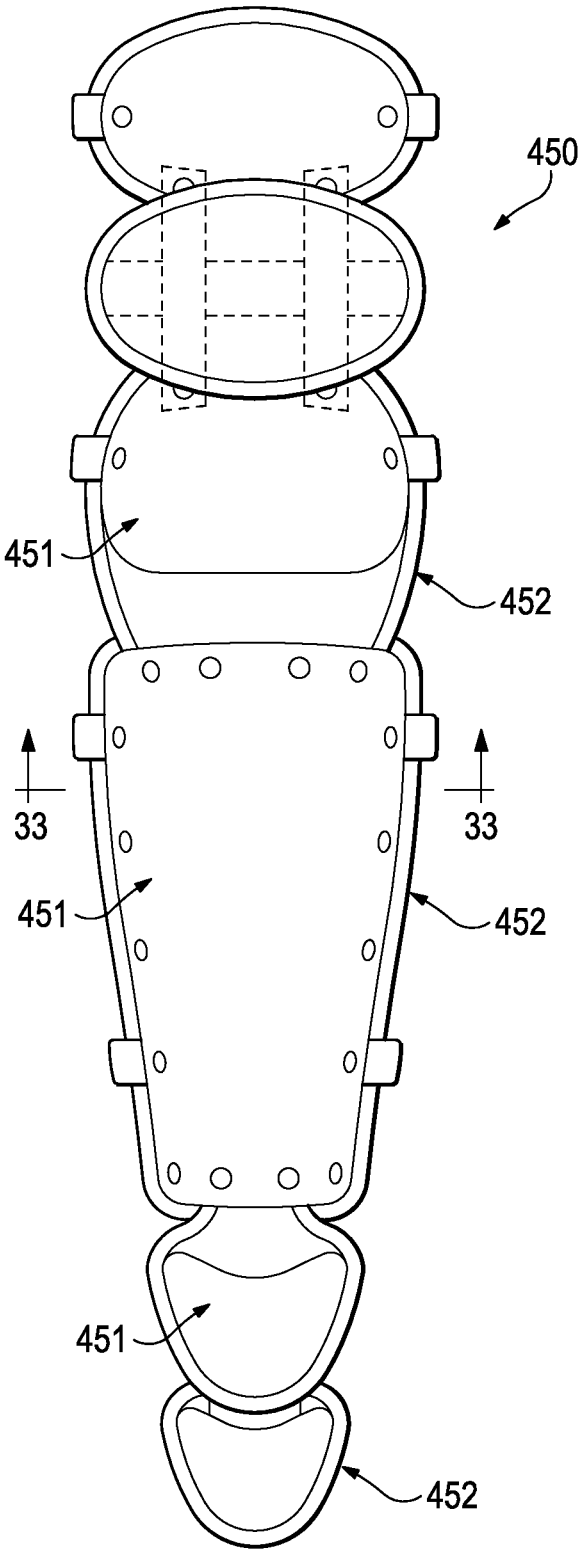
FIG. 32 is a front elevational view of an article of protective apparel having a configuration of a leg guard.
Figure 33:
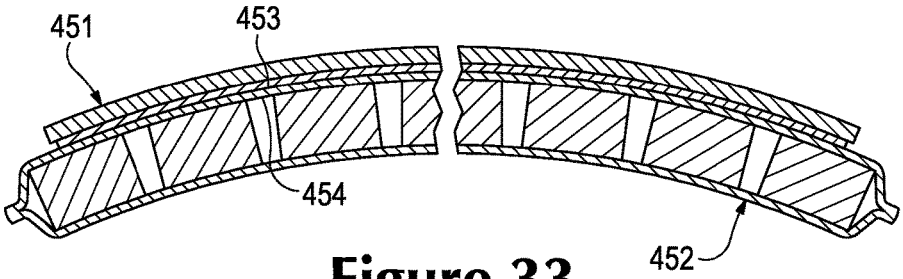
FIG. 33 is a cross-sectional view of the article of protective apparel, as defined by section line 33 in FIG. 32.

Shoulder pads provide one example of the types of protective apparel that may incorporate the features discussed above for protective apparel 400. Other examples that may include plate elements and cushioning elements joined by a hook-and-loop fastening system include (a) further pads utilized for American football, (b) soccer shin guards, (c) helmets for a variety of sports, (d) hockey pads, and (e) protective devices for bicycling, skateboarding, skiing, snowboarding, and various motorsports. As another example, FIG. 32 depicts a baseball catcher's leg guard 450 that includes multiple plate elements 451 and cushioning elements 452. Referring to the cross-section of FIG. 33, parts 453 and 454 of a hook-and-loop fastening system may be utilized to join elements 451 and 452. Although suited for athletic activities, protective apparel having these features may also be utilized in non-athletic pursuits, such as protective apparel for law enforcement, the military, or various other work-related activities. Accordingly, the general structure discussed above for protective apparel 400 may be utilized for various protective apparel configurations.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel comprising:

a cushioning element having a first cushioning-element surface facing in a first direction and a second cushioning-element surface facing in a second direction that is opposite to, and away from, the first direction, wherein the cushioning element comprises a pad component between the first and second surfaces;

a plate element, the plate element having a cushion-facing surface facing in the second direction and towards the cushioning element and an outward-facing surface facing in the first direction and away from the cushioning element;

wherein the cushion-facing surface is coupled to the first cushioning-element surface via a hook-and-loop fastening system; and wherein peripheral edges of the plate element are spaced inward from peripheral edges of the cushioning element.

2. The article of apparel of claim 1, wherein the cushioning element further comprises a first material layer coupled to the pad component and forming the first cushioning-element surface and a second material layer coupled to the pad component and forming the second cushioning-element surface.

3. The article of apparel of claim 2, wherein the first material layer includes a polymer sheet.

4. The article of apparel of claim 1, wherein a first part of the hook-and-loop fastening system is coupled to the cushion-facing surface of the plate element, and wherein a second part of the hook-and-loop fastening system is located on the first cushioning-element surface.

5. The article of apparel of claim 1, wherein the pad component comprises a first plurality of indentations and a second plurality of indentations, wherein the first plurality of indentations and the second plurality of indentations intersect to form an angle.

6. The article of apparel of claim 5, wherein the first plurality of indentations and the second plurality of indentations extend partially through the pad component.

7. The article of apparel of claim 5, wherein the first plurality of indentations and the second plurality of indentations are perpendicular.

8. The article of apparel of claim 1, wherein the pad component comprises a first plurality of elongated voids and a second plurality of elongated voids, and wherein the first plurality of elongated voids and the second plurality of elongated voids intersect to form an angle.

9. An article of apparel comprising:

a base layer having an inner-facing surface and an outer-facing surface;

a cushioning element having a first cushioning-element surface facing in a first direction and a second cushioning-element surface facing in a second direction that is opposite to, and away from, the first direction, the cushioning element including a pad component disposed between a first material layer and the base layer;

a plate element, the plate element having a cushion-facing surface facing in the second direction and towards the cushioning element and an outward-facing surface facing in the first direction and away from the cushioning element; and a hook-and-loop fastening system, wherein a first part of the hook-and-loop fastening system is positioned on the cushioning element and a second part of the hook-and-loop fastening system is positioned on the plate element;

wherein the surface area of the first cushioning-element surface and the second cushioning-element surface is greater than the surface area of the cushion-facing surface and the outward-facing surface.

10. The article of apparel of claim 9, wherein the cushioning element further comprises a second material layer coupled to the second cushioning-element surface.

11. The article of apparel of claim 9, wherein the pad component includes a thickness and a first plurality of indentations extending partially through the thickness.

12. The article of apparel of claim 9, wherein the pad component comprises a first plurality of elongated voids and a second plurality of elongated voids, and wherein the first plurality of elongated voids and the second plurality of elongated voids intersect to form an angle.

13. The article of apparel of claim 9, wherein a peripheral edge of the plate element is offset a distance from a peripheral edge of the cushioning element.

14. The article of apparel of claim 13, wherein the distance is between 0 and 3 inches.

15. A pants-type garment comprising:

a base layer having an inner surface and an outer surface, the base layer having a pelvic region and two leg regions extending from the pelvic region;

a cushioning element having an inner surface facing in a first direction and an outer surface facing a second direction that is opposite to, and away from, the first direction, the inner surface of the cushioning element coupled to the outer surface of the base layer;

a plate element, the plate element having a cushion-facing surface facing in the second direction and towards the cushioning element and an outward-facing surface facing in the first direction and away from the cushioning element;

a hook-and-loop fastening system, wherein a first part of the hook-and-loop fastening system is disposed on an outer surface of the cushioning element, and wherein a second part of the hook-and-loop fastening system is disposed on the inner surface of the plate component, and wherein peripheral edges of the plate element are spaced inward from peripheral edges of the cushioning element.

16. The pants-type garment of claim 15, wherein each of the two leg regions comprises the cushioning element and the plate element.

17. The pants-type garment of claim 15, wherein a polymer sheet is coupled to the base layer at least partially around a perimeter of the cushioning element to secure the cushioning element between the polymer sheet and the base layer.

18. The pants-type garment of claim 15, wherein the cushioning element and the plate element are configured to align with a thigh of a wearer when the pants-type garment is in an as-worn configuration.

19. The article of apparel of claim 15, wherein the cushioning element includes a thickness and a first plurality of indentations extending partially through the thickness.

20. The article of apparel of claim 19, wherein the pad component comprises a first plurality of elongated voids and a second plurality of elongated voids, and wherein the first plurality of elongated voids and the second plurality of elongated voids intersect to form an angle.

* * * * *